US011395567B2

(12) United States Patent
Landa et al.

(10) Patent No.: US 11,395,567 B2
(45) Date of Patent: Jul. 26, 2022

(54) AUTOMATIC DROP-DOWN DISPENSER

(71) Applicant: Dispensing Dynamics International, Inc., San Marcos, CA (US)

(72) Inventors: Victor Landa, City of Industry, CA (US); Joel P. Keily, City of Industry, CA (US)

(73) Assignee: Dispensing Dynamics International, Inc., San Marcos, CA (US)

( * ) Notice: Subject to any disclaimer, the term of this patent is extended or adjusted under 35 U.S.C. 154(b) by 157 days.

(21) Appl. No.: 16/833,189

(22) Filed: Mar. 27, 2020

(65) Prior Publication Data

US 2020/0305656 A1 Oct. 1, 2020

Related U.S. Application Data

(60) Provisional application No. 62/825,641, filed on Mar. 28, 2019.

(51) Int. Cl.
*A47K 10/36* (2006.01)

(52) U.S. Cl.
CPC .. *A47K 10/3687* (2013.01); *A47K 2010/3681* (2013.01)

(58) Field of Classification Search
CPC ..... A47K 10/3687; A47K 2010/3681
See application file for complete search history.

(56) References Cited

U.S. PATENT DOCUMENTS 2,299,301 A 10/1942 Britt et al.
3,126,234 A 3/1964 Batlas et al.
3,211,504 A 10/1965 Bump
3,214,014 A 10/1965 Perrin
3,381,909 A 5/1968 Tucker et al.
3,387,902 A 6/1968 Perrin et al.
(Continued)

FOREIGN PATENT DOCUMENTS

GB 1339084 A 11/1973
WO WO 02/074148 A1 9/2002

OTHER PUBLICATIONS

"The International Dispensing System" Catalog, Dispensing Dynamics International, 2010, pp. 1-60.
(Continued)

*Primary Examiner* — William A. Rivera
(74) *Attorney, Agent, or Firm* — Knobbe, Martens, Olson & Bear, LLP

(57) ABSTRACT

An apparatus for dispensing consumable material can include a housing, first and second support frames, a mandrel, and a lever. The mandrel can be movably mounted to the support frames between upper and lower positions and configured to hold upper and lower rolls. In some embodiments, when the mandrel is in the upper position, only the lower roll is accessible, and when the mandrel is in the lower position, both of the upper and lower rolls are accessible. The lever can be operatively connected to the first support frame and moveable between first and second positions. In some embodiments, when in the first position, a portion of the lever presents a physical interference that inhibits the mandrel from moving from the upper position to the lower position and, when moved to the second position, the physical interference is removed, thereby allowing the mandrel to move.

21 Claims, 16 Drawing Sheets

(56) References Cited

U.S. PATENT DOCUMENTS

| | | | | |
|---|---|---|---|---|
| 3,677,485 | A | 7/1972 | Berg | |
| 3,690,580 | A | 9/1972 | Jespersen | |
| 3,698,653 | A | 10/1972 | Okamura | |
| 3,754,719 | A | 8/1973 | Choy | |
| 3,770,222 | A | 11/1973 | Jespersen | |
| 3,948,454 | A | 4/1976 | Bastian | |
| 4,143,827 | A * | 3/1979 | Tucker | A47K 10/3836 242/560.3 |
| 4,222,621 | A * | 9/1980 | Greenlee | A47K 10/40 242/559 |
| 4,340,195 | A | 7/1982 | DeLuca | |
| 4,383,657 | A | 5/1983 | Suh | |
| 4,422,584 | A | 12/1983 | Dashnier et al. | |
| 4,422,585 | A | 12/1983 | Schultz et al. | |
| 4,662,664 | A | 5/1987 | Wendt et al. | |
| 5,265,816 | A | 11/1993 | Collins | |
| 5,628,474 | A | 5/1997 | Krueger et al. | |
| 5,645,244 | A | 7/1997 | Moody | |
| 5,690,299 | A | 11/1997 | Perrin et al. | |
| 5,865,395 | A | 2/1999 | Wei | |
| 5,868,335 | A | 2/1999 | Lebrun | |
| 5,873,542 | A * | 2/1999 | Perrin | A47K 10/3836 242/560 |
| 5,954,256 | A | 9/1999 | Niada | |
| 6,145,779 | A | 11/2000 | Johnson et al. | |
| 6,202,956 | B1 | 3/2001 | Grasso et al. | |
| 6,237,871 | B1 | 5/2001 | Morand et al. | |
| 6,508,432 | B2 | 1/2003 | Krivulin | |
| 7,182,288 | B2 | 2/2007 | Denen et al. | |
| 7,866,593 | B2 | 1/2011 | Friesen et al. | |
| 7,878,444 | B2 * | 2/2011 | Friesen | A47K 10/3687 242/559.4 |
| 7,913,945 | B2 * | 3/2011 | Friesen | A47K 10/3687 242/559.4 |
| 8,162,252 | B2 * | 4/2012 | Cittadino | A47K 10/3687 242/560 |
| 2003/0146337 | A1 * | 8/2003 | Moody | A47K 10/38 242/594 |
| 2008/0078855 | A1 | 4/2008 | Forman et al. | |
| 2011/0042503 | A1 * | 2/2011 | Hagleitner | A47K 10/3687 242/560 |
| 2013/0320130 | A1 * | 12/2013 | Osborne, Jr. | A47K 10/38 242/561 |
| 2018/0263434 | A1 * | 9/2018 | Babikian | A47K 10/38 |
| 2018/0325332 | A1 * | 11/2018 | Grosz, Jr. | A47K 10/3836 |
| 2019/0104895 | A1 * | 4/2019 | Johnson | A47K 10/3687 |

OTHER PUBLICATIONS

International Search Report, re PCT Application No. PCT/CA2002/000345 dated Jun. 27, 2002.

* cited by examiner

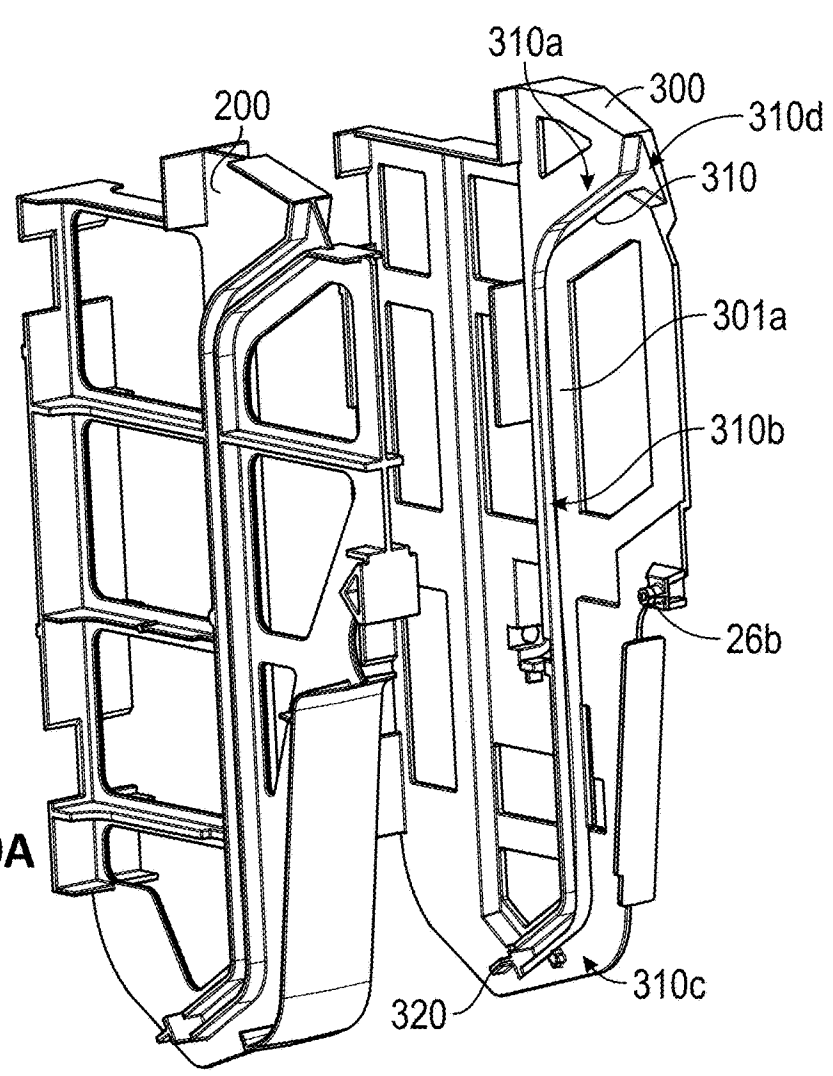
FIG. 7B
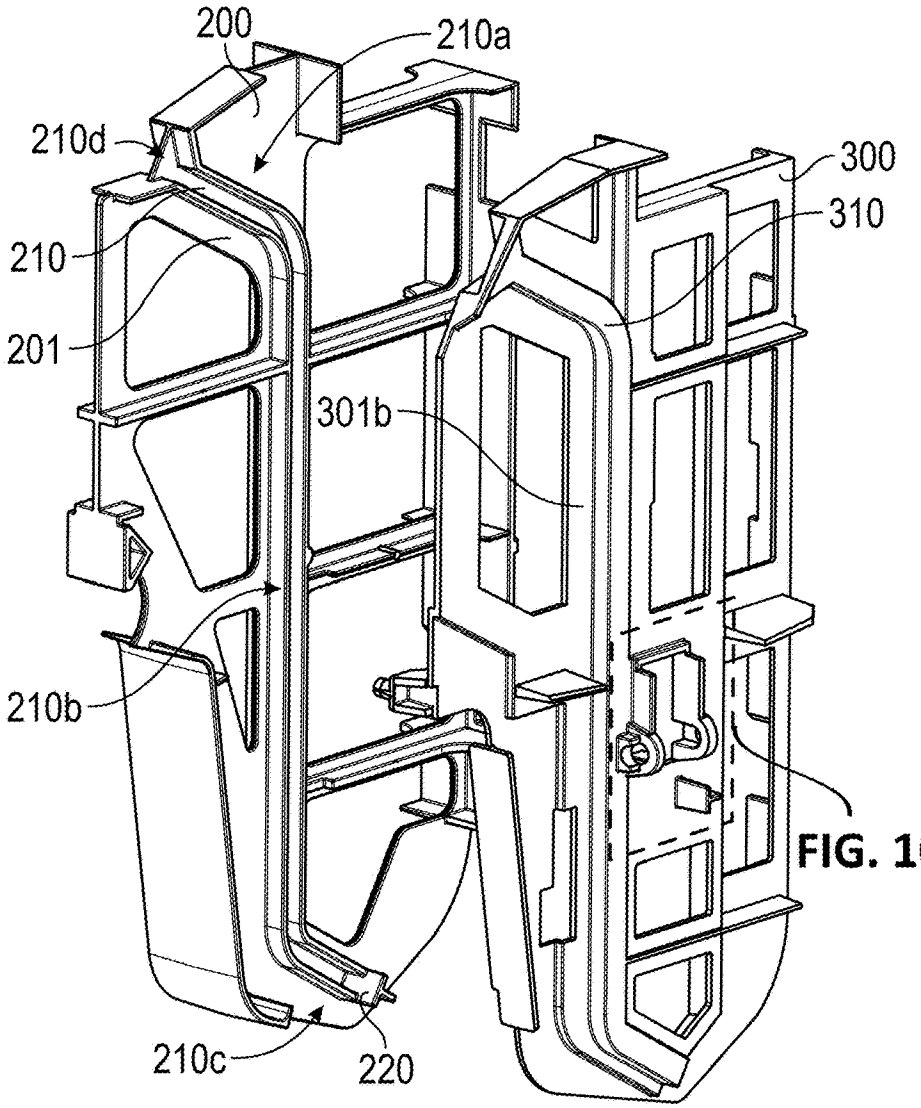
FIG. 10A
FIG. 7A

AUTOMATIC DROP-DOWN DISPENSER

CROSS REFERENCE

This application claims the priority benefit of U.S. Provisional Patent Application No. 62/825,641, filed Mar. 28, 2019, the entirety of which is incorporated by reference herein.

BACKGROUND

Field

This disclosure generally relates to an apparatus for dispensing consumable material, such as paper tissue from tissue rolls.

Description of Certain Related Art

Tissue dispensers provide a convenient storage system for rolls of consumable material. The rolls of consumable material can be referred to as "tissue rolls," for example, rolls of fibrous paper products or tissue paper (e.g., bathroom tissue, paper towels, or other). Tissue dispensers are generally designed to hold one or multiple rolls of tissue paper and to provide a dispensing mechanism. The dispensing mechanism generally allows a user to retrieve a length of the roll. As one length of tissue paper is retrieved from the dispensing mechanism, an additional length becomes available for retrieval from the roll. This process slowly unrolls the length of the roll of tissue paper.

SUMMARY OF CERTAIN FEATURES

In some instances where a tissue dispenser holds multiple tissue rolls, for example, in a vertical configuration, it is often difficult for a user to access rolls above the bottommost roll even after the bottommost roll is exhausted. In some cases, when such bottommost roll is exhausted, a user must reach into an interior of the tissue dispenser to access additional rolls and/or must make manual adjustments to the tissue dispenser (or structure inside the tissue dispenser holding the rolls) in order to allow for access. Such techniques can not only be difficult, but can also present health concerns where users are required to touch the tissue rolls or structure holding the tissue rolls inside the interior of the dispenser. It would be beneficial to have a tissue dispenser that automatically provides access to an additional roll after a first roll is exhausted beyond a certain limit, without requiring additional action by a user. In addition to providing access to the additional roll, it would also be beneficial for the tissue dispenser to continue providing access to the first roll even after such roll is exhausted beyond a limit.

At least some of the aforementioned issues, or other issues, are overcome by various implementations of the solutions described herein. For example, one aspect of some implementations of a tissue dispenser described herein includes structural components that interact to automatically provide accessibility to a new tissue roll when a first tissue roll is exhausted or is near exhaustion. For example, in some implementations, when a first tissue roll is exhausted beyond a certain threshold (e.g., a diameter of the roll falls below a threshold), a new tissue roll held within the dispenser is automatically moved closer to an opening of the dispenser to provide accessibility to a user. As discussed herein, the tissue dispenser can include a mandrel for holding one or more tissue rolls (for example, vertically) and a sensor and/or controller (e.g., a lever). The sensor can be configured to detect whether a condition is satisfied, such as whether an outside diameter of a first tissue roll being detected to be below a threshold diameter. In some implementations, the controller can be configured to inhibit or prevent the mandrel from moving (e.g., closer to the opening of the dispenser) until the condition is satisfied, such as an outside diameter of a first tissue roll being at or below a threshold.

The preceding summary is meant to be a high-level summary of certain features within the scope of this disclosure. The summary, the following detailed description, and the associated drawings do not limit or define the scope of protection. The scope of protection is defined by the claims. No feature is critical or indispensable.

An apparatus for dispensing consumable material can comprise: a housing comprising a cabinet an interior, and an opening; a first support frame positioned within the interior of the housing and mounted to the cabinet; a second support frame positioned within the interior of the housing and mounted to the cabinet, the second support frame being spaced apart from the first support frame; and a mandrel positioned between the first support frame and the second support frame, the mandrel being movable between an upper position and a lower position relative to the first support frame and the second support frame. In some embodiments, the mandrel is configured to hold an upper roll of consumable material and a lower roll of consumable material, wherein when the mandrel is in the upper position the lower roll is accessible to a user via the opening of the housing, and when the mandrel is in the lower position the upper and lower rolls are accessible to the user via the opening. In some embodiments, the apparatus further comprises a lever operatively connected to the first support frame and moveable between a first position and a second position. In some embodiments, the lever is configured such that: when the lever is in the first position, a portion of the lever presents a physical interference that inhibits the mandrel from moving from the upper position to the lower position; and when the lever is moved to the second position, the physical interference is removed, thereby allowing the mandrel to move from the upper position to the lower position.

In some embodiments, the lever comprises a first arm and a second arm, and wherein, when the lever is in the first position, the first arm contacts the lower roll and the second arm presents the physical interference that inhibits the mandrel from moving from the upper position to the lower position. In some embodiments, when a diameter of the lower roll is greater than or equal to a threshold, the lower roll presents a physical obstacle to the first arm of the lever and prevents the lever from moving from the first position to the second position; and when the diameter falls below the threshold, the physical obstacle is removed, thereby allowing the lever to move from the first position to the second position. In some embodiments, the first arm of the lever is closer to the second support frame when the lever is in the second position than when the lever is in the first position.

In some embodiments, the mandrel comprises a first stem movably mounted to the first support frame, a second stem movably mounted to the second support frame, and a cross-member connected to and positioned between the first and second stems, and wherein the mandrel is configured to hold the upper and lower rolls between the first and second stems. In some embodiments, the first stem comprises a first flange, and wherein, when the lever is in the first position, the second arm of the lever contacts the first flange of the first stem. In some embodiments, the first support frame comprises a first channel extending along at least a portion of a first height of the first support frame; the second support frame comprises a second channel extending along at least a portion of a second height of the second support frame; the first stem is movably mounted within the first channel of the first support frame; and the second stem is movably mounted within the second channel of the second support frame. In some embodiments, the first stem comprises a first guide configured to fit within the first channel of the first support frame and the second stem comprises a second guide configured to fit within the second channel of the second support frame, and wherein the first and second guides are configured to allow the first and second stems to move within the first and second channels. In some embodiments, the first stem further comprises a first stub configured to secure to a first portion of the lower tissue roll and the second stem further comprises a second stub configured to secure to a second portion of the lower tissue roll, and wherein the first guide and the first stub extend from the first stem in opposite directions, and wherein the second guide and the second stub extend from the second stem in opposite directions.

In some embodiments, the lever is pivotably connected to the first support frame. In some embodiments, the lever is biased toward the second position. In some embodiments, the lever is connected to the first support frame via a pin and a torsional spring coupled to the pin, the torsional spring configured to bias the lever toward the second position. In some embodiments, the apparatus further comprises a cover that is movably mounted to the cabinet.

An apparatus for dispensing consumable material can comprise: a housing comprising a cabinet, an interior, and an opening; a first support frame positioned within the interior of the housing and mounted to the cabinet; a second support frame positioned within the interior of the housing and mounted to the cabinet, the second support frame being spaced apart from the first support frame; and a mandrel movably mounted to the first and second support frames and configured to hold an upper roll of consumable material and a lower roll of consumable material. In some embodiments, the mandrel is movable between an upper position and a lower position, and wherein, when the mandrel is in the upper position, only the lower roll is accessible to a user via the opening of the housing, and wherein, when the mandrel is in the lower position, the upper and lower rolls are accessible to the user via the opening of the housing.

In some embodiments, the apparatus further comprises a lever operatively connected to the first support frame and moveable between a first position and a second position, the lever configured such that: when the lever is in the first position, a portion of the lever presents a physical interference that inhibits the mandrel from moving from the upper position to the lower position; and when the lever is moved to the second position, the physical interference is removed, thereby allowing the mandrel to move from the upper position to the lower position. In some embodiments, the lever comprises a first arm and a second arm, and wherein, when the lever is in the first position, the first arm contacts the lower roll and the second arm presents the physical interference that inhibits the mandrel from moving from the upper position to the lower position.

In some embodiments, the mandrel comprises a first stem movably mounted to the first support frame, a second stem movably mounted to the second support frame, and a cross-member connected to and positioned between the first and second stems, and wherein the mandrel is configured to hold the upper and lower rolls between the first and second stems. In some embodiments, the first stem comprises a first flange, and wherein, when the lever is in the first position, the second arm of the lever contacts the first flange of the first stem. In some embodiments, the first support frame comprises a first channel extending along at least a portion of a first height of the first support frame, the second support frame comprises a second channel extending along at least a portion of a second height of the second support frame, the first stem is movably mounted within the first channel of the first support frame, and the second stem is movably mounted within the second channel of the second support frame. In some embodiments, the first stem comprises a first pair of guides and the second stem comprises a second pair of guides, and wherein the first pair of guides are configured to move within the first channel of the first support frame and the second pair of guides are configured to move within the second channel of the second support frame. In some embodiments, the apparatus further comprises a lever assembly comprising a controller arm and a sensor arm, the controller arm configured to disengage from the mandrel in response to the sensor arm detecting that an outside diameter of the lower roll is less than a threshold value, thereby allowing the mandrel to automatically drop from the upper position to the lower position.

BRIEF DESCRIPTION OF THE DRAWINGS

Certain features of this disclosure are described below with reference to the drawings. The illustrated embodiments are intended to illustrate, but not to limit the embodiments. Various features of the different disclosed embodiments can be combined to form further embodiments, which are part of this disclosure.

FIGS. 7A-7B illustrate perspective views of the support frames of the tissue dispenser.

DETAILED DESCRIPTION OF CERTAIN EMBODIMENTS

Various features and advantages of the disclosed technology will become more fully apparent from the following description of the several specific embodiments illustrated in the figures. These embodiments are intended to illustrate the principles of this disclosure. However, this disclosure should not be limited to only the illustrated embodiments. The features of the illustrated embodiments can be modified, combined, removed, and/or substituted as will be apparent to those of ordinary skill in the art upon consideration of the principles disclosed herein.

Overview

Figure 1C:
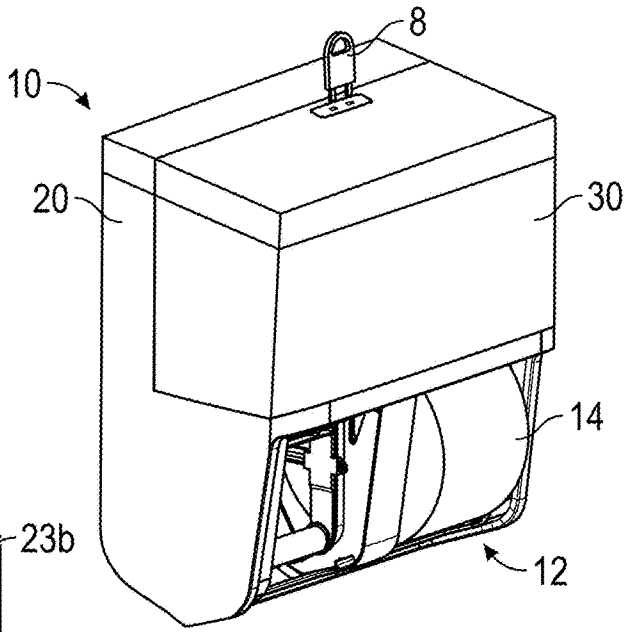
FIGS. 1A-1C illustrate various perspective views of a tissue dispenser.
Figure 1B:
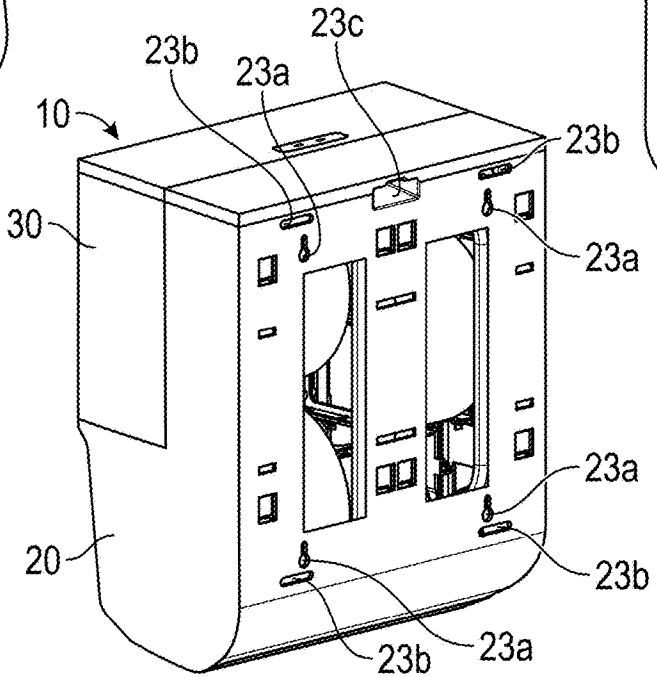
Figure 1A:
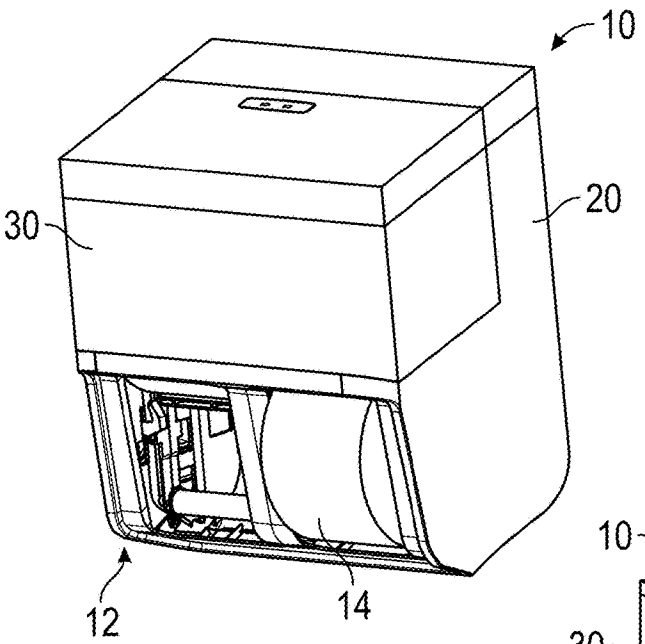

FIGS. 1A-1C illustrate various perspective views of a dispenser 10. FIGS. 1A and 1C illustrate front perspective views of the dispenser 10, while FIG. 1B illustrates a back perspective view of the dispenser 10. As discussed herein, the dispenser 10 can allow for dispensing of a roll of consumable material (also called a "tissue roll"), such as paper towels, toilet tissue, facial tissue, cleaning wipes, etc. In some variants, the dispenser 10 provides access to consumable material that is wound on a core and positioned within an interior of the dispenser 10. The dispenser 10 can be a toilet paper dispenser, paper towel dispenser, facial tissue dispenser, wipes dispenser, or other type of dispenser capable of dispensing and/or providing access to consumable material.

As shown, the dispenser 10 can include a support portion, such as a cabinet 20. An opening 12 can be bounded by or part of the cabinet 20. As shown, one or more rolls of consumable material, such as tissue rolls 14, can be held within an interior of the dispenser 10, as described further below.

Figure 2B:
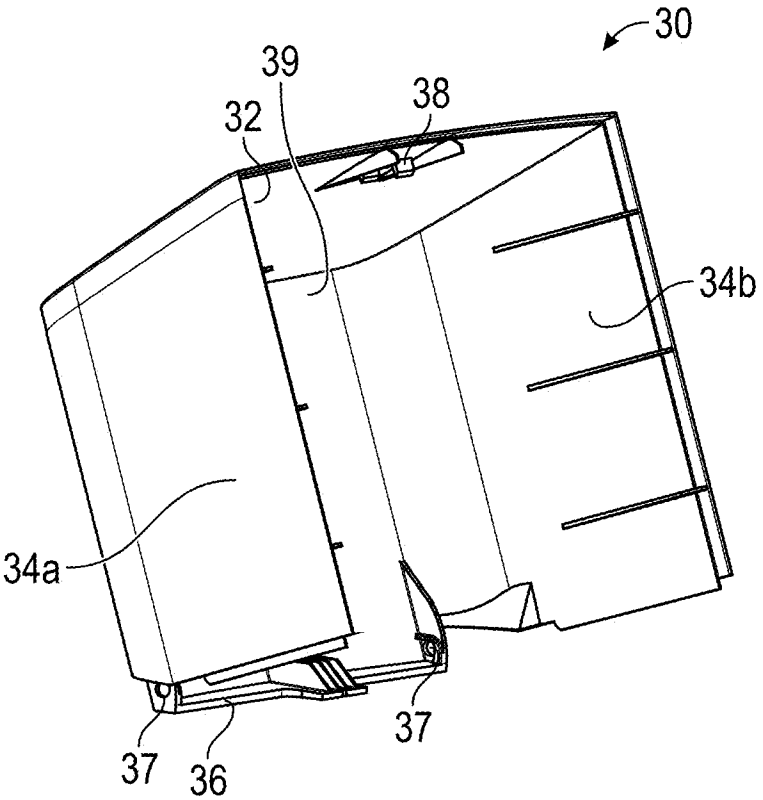
FIG. 2B illustrates a perspective view of the cover of the tissue dispenser.
Figure 2A:
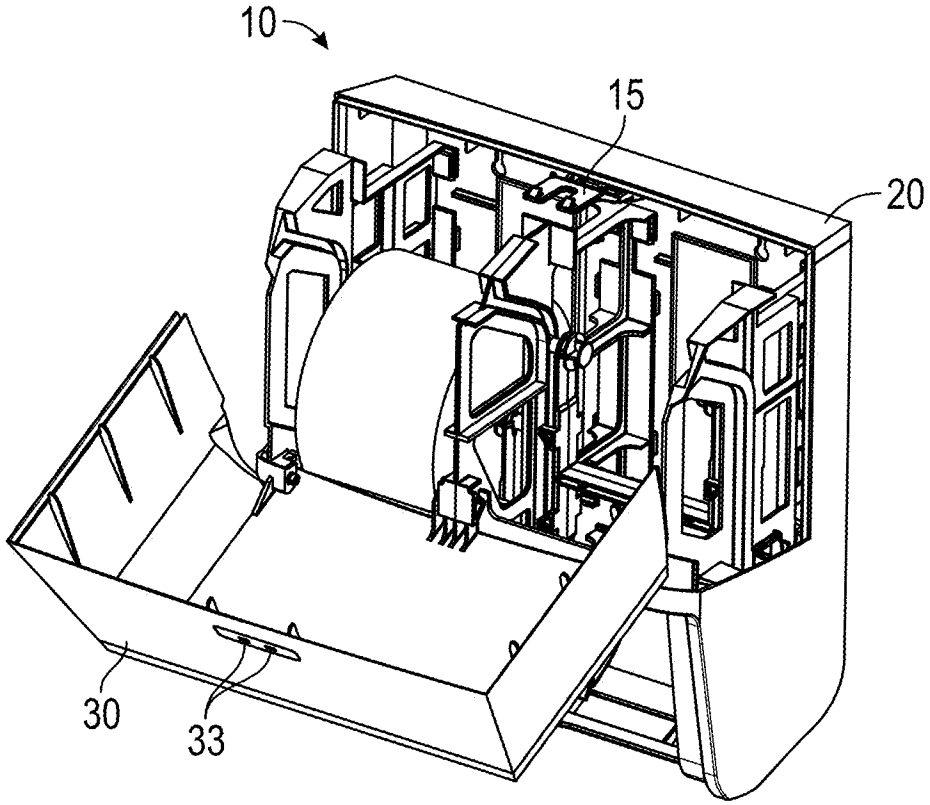
FIG. 2A illustrates a perspective view of the tissue dispenser where a cover of the tissue dispenser is open.
Figure 4B:
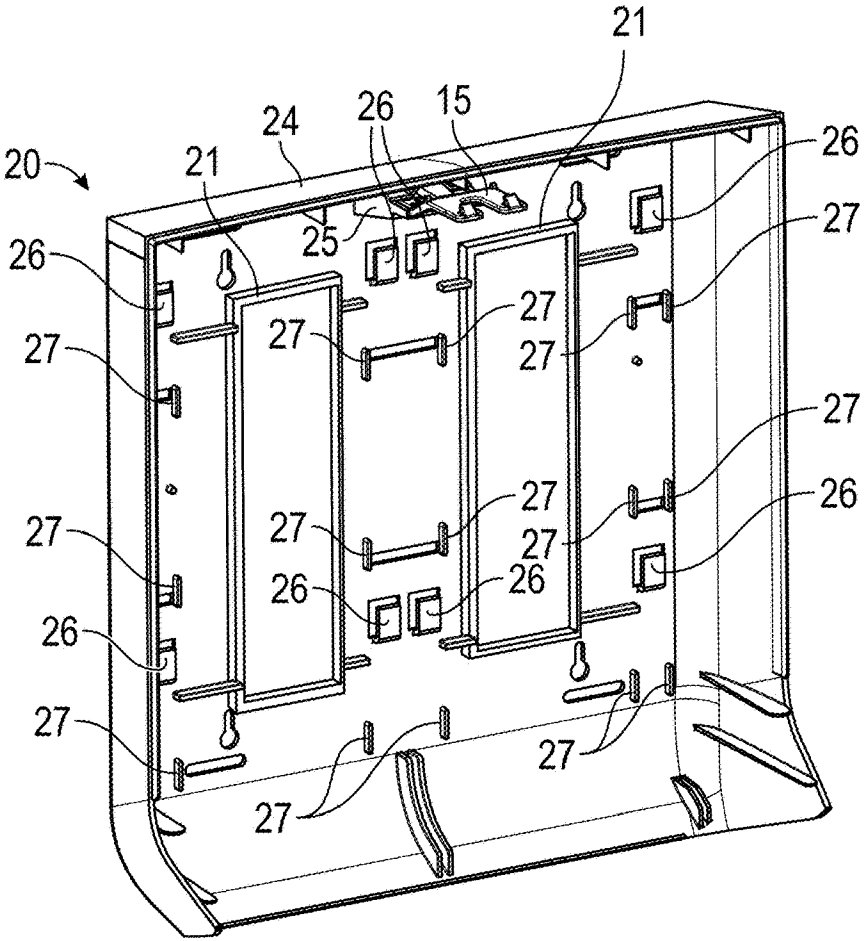
FIGS. 4A-4B illustrate perspective views of a portion of a cabinet of the tissue dispenser.
Figure 4A:
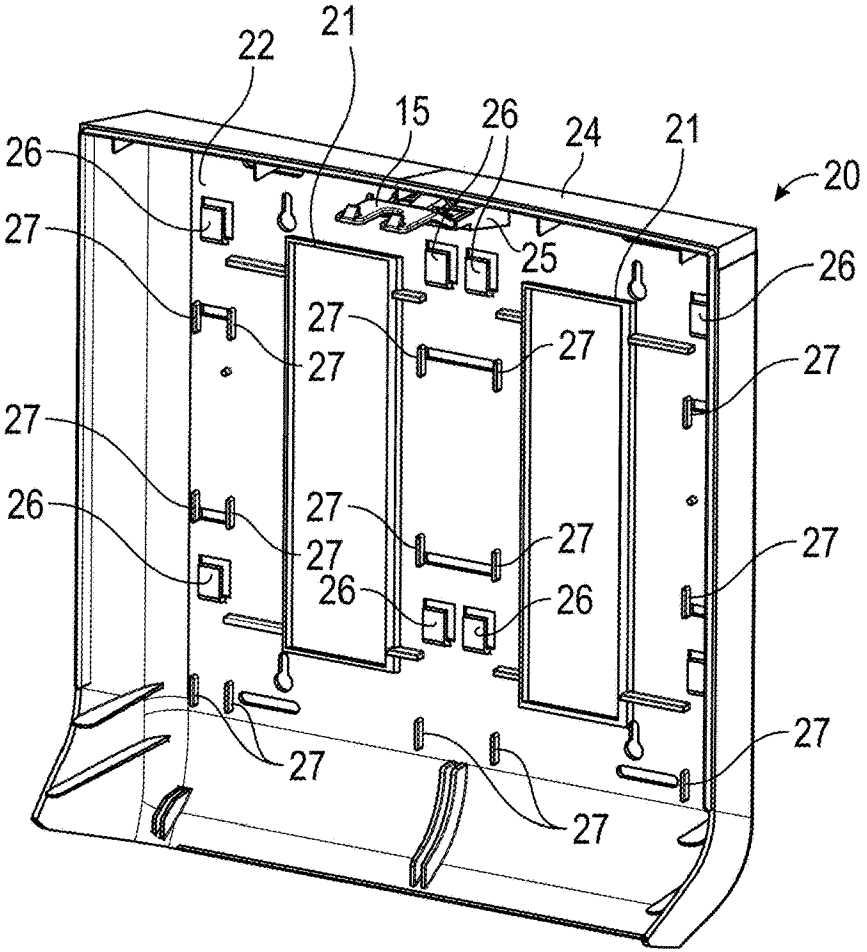

The dispenser can include a cover 30 that is connected with the cabinet 20. With reference to FIGS. 2A-2B and 1C, the dispenser 10 can include a latch 15 that allows the cover 30 to removably secure to the cabinet 20. For example, the cover 30 can include a latching portion 38 (FIG. 2B) that can connect to the latch 15. Further, with reference to FIGS. 1C and 2A, the cover 30 can include one or more openings 33 sized to receive portions of a key 8 that can interact with the latch 15 and/or latching portion 38 to disengage the cover 30 from the cabinet 20. With reference to FIGS. 4A-4B, in some embodiments, the latch 15 is removably connected to a portion of the cabinet 20, for example, to a latch housing 25 of the cabinet 20. As shown in FIG. 1B, the cabinet 20 can include one or more openings 23*a*, 23*b*, 23*c* configured to facilitate mounting of the dispenser 10 to a wall. For example, the one or more openings 23*a*, 23*b*, 23*c* can be sized and/or shaped to receive fasteners in order to assist in mounting the dispenser 10 to a wall.

In some embodiments, the cover 30 is movably connected to the cabinet 20. For example, with reference to FIGS. 2A-2B, the cover 30 can be rotatably coupled to the cabinet 20 such that, when the latching portion 38 is disengaged from the latch 15 of the cabinet 20, the cover 30 can rotate with respect to the cabinet 20. Such configuration can allow the cover 30 to be rotatably opened to allow access into the interior of the dispenser 10. Such access can allow a user to insert one or more tissue rolls into the dispenser 10, for example, via insertion of a mandrel 400 holding one or more tissue rolls into channels 210, 310 as discussed further below. As shown in FIG. 2B, the cover can include a top portion 32, which can include the latching portion 38, a front (or back) wall 39, and sidewalls 34*a*, 34*b*. In some embodiments, the cover 30 can include a coupling portion 36 extending from and/or connected to a portion (e.g., a bottom) of the wall 39. The coupling portion 36 can include one or more openings, such as two openings 37 (FIG. 2B) configured to receive protrusions on the cabinet 20 or another portion of the dispenser 10. For example, with reference to FIGS. 2B, 3A-3B, and 5A-5B, the openings 37 of the coupling portion 36 can receive protrusions 26*a*, 26*b* on support frames 100, 300 which also extend through openings in the cabinet 20. Such configuration can allow the cover 30 to rotate while connected to the cabinet 20 between an open position (e.g., FIG. 2A) and a closed position (e.g., FIGS. 1A-1C). In some embodiments, the openings 37 are circular apertures and the protrusions 26*a*, 26*b* have a circular cross-section.

Figure 3B:
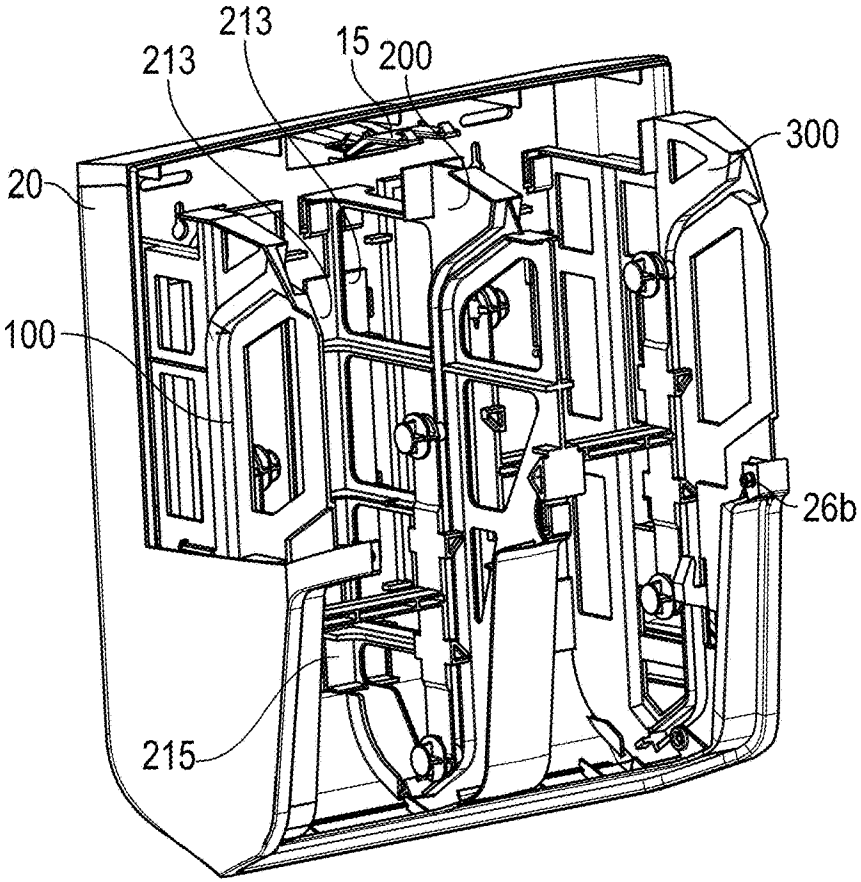
FIGS. 3A-3B illustrate perspective views of the tissue dispenser with the cover removed.
Figure 3A:
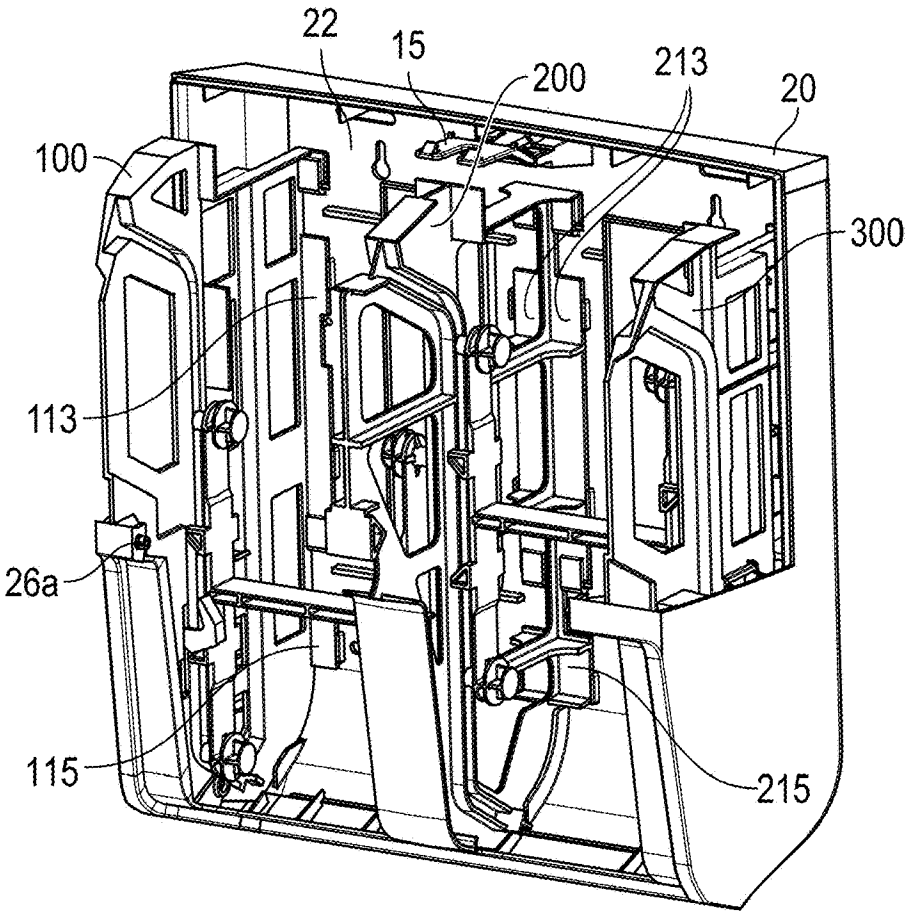

FIGS. 3A-3B show views of the dispenser 10 with the cover 30 removed so as to better illustrate the interior of the dispenser 10. FIGS. 4A-4B illustrate perspective views of the cabinet 20 with a portion thereof removed to better show features on a back surface 22 of the cabinet 20. As discussed elsewhere herein, the dispenser 10 can include one or more support frames that connect to the cabinet 20 and/or the cover 30 and that act to support one or more tissue rolls and/or structure holding the one or more tissue rolls within the interior of the dispenser 10. For example, as discussed in more detail below, the dispenser 10 can include one or more support frames 100, 200, and/or 300 as shown in at least FIGS. 3A-3B and 5A-5B. The support frames 100, 200, 300 can connect (for example, removably secure) to the cabinet 20. With reference to FIGS. 4A-4B, the cabinet 20 can include one or more flanges 26 extending outward from a surface 22 of the cabinet 20. As shown, the flanges 26 can extend outward with respect to the surface 22 and extend in an additional direction (for example, "upward"). As also shown, the flanges 26 can define a space (or "open cavity") sized to receive portions of the support frames 100, 200, 300 to enable securement of the same. For example, as shown in at least FIGS. 5A-5B, the support frames 100, 200, 300 can include flanges 111, 211, 311, 113, 213, 313 that can secure within the open cavities defined by the flanges 26 in the cabinet 20. In some variants, the cabinet 20 can include one or more pairs of protrusions 27 extending from the surface 22 of the cabinet 20 that form slots that are sized to receive one or portions of the support frames 100, 200, 300 to help secure the support frames 100, 200, 300 to the cabinet 20. For example, with reference to at least FIGS. 3A-3B and 5A-6B, the support frames 100, 200, 300 can include flanges 113, 213, 313, 115, 215, 315 that can secure within the slots defined by the protrusions 27. Accordingly, the interaction of the flanges 26 and protrusions 27 of the cabinet 20 and the flanges 111, 211, 311, 113, 213, 313, 115, 215, 315 of the support frames 100, 200, 300 can allow the support frames 100, 200, 300 to secure to the cabinet 20. Such securement can prevent horizontal and/or vertical movement of the support frames 100, 200, 300 relative to the cabinet 20 in some embodiments.

Support Frames

Figure 5B:
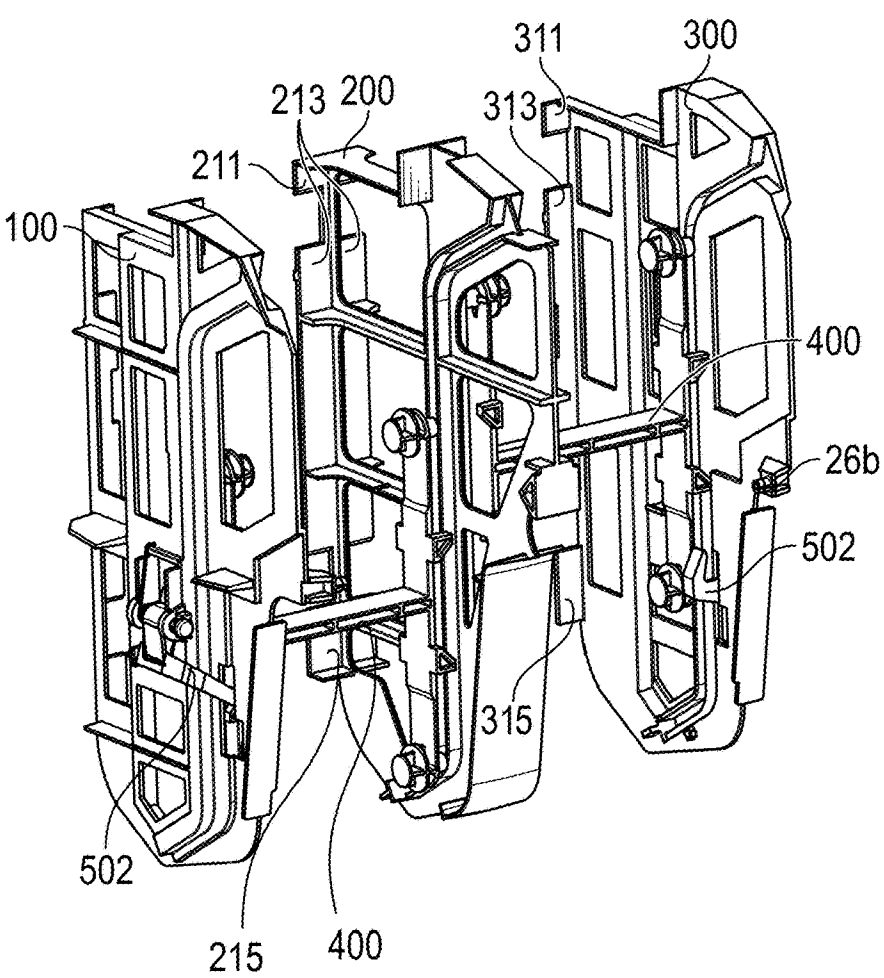
FIGS. 5A-5B illustrate perspective views of the tissue dispenser with the cover and cabinet removed.
Figure 5A:
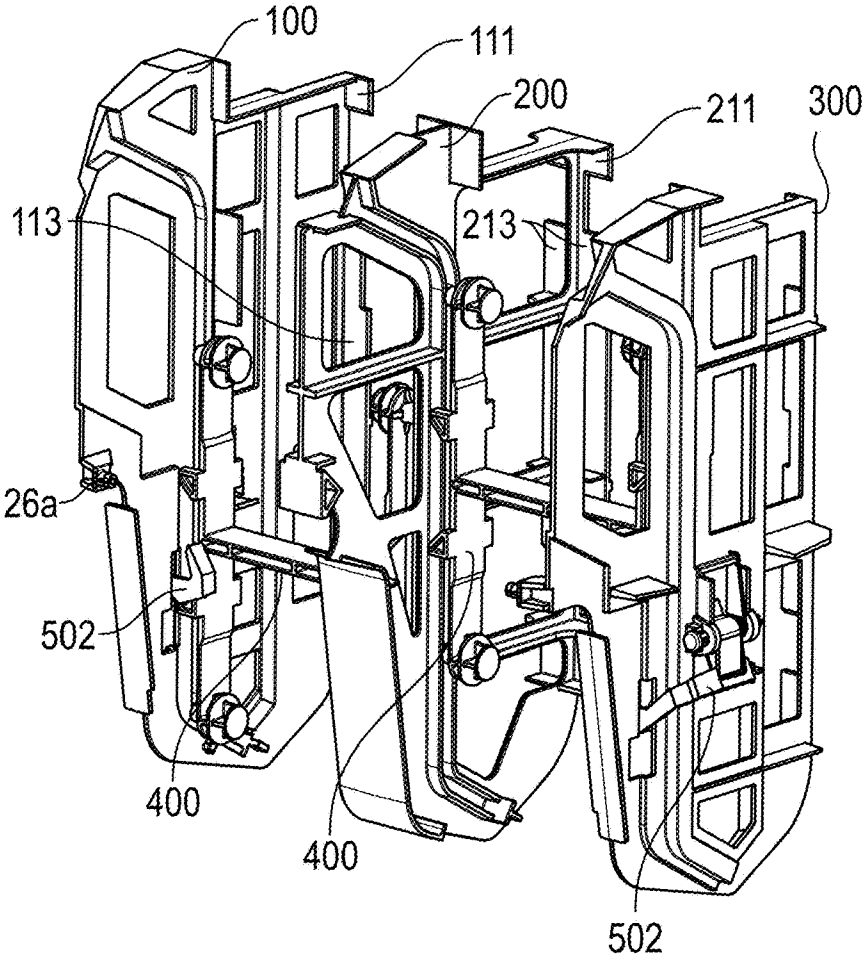

FIGS. 5A-5B show the dispenser 10 with the cabinet 20 and cover 30 removed to better illustrate the support frames 100, 200, 300 and other aspects of the tissue dispenser 10. As shown, the dispenser 10 can include the support frames 100, 200, 300, mandrels 400, and levers 502. As discussed in more detail below, the mandrels 400 can hold one or more rolls of consumable material (such as tissue rolls 14) and can be movably secured to the support frames 100, 200, 300. As also discussed in more detail below, the levers 502 can be movably secured to the support frames 100, 300 and can interact with the mandrels 400 to at least partially inhibit (e.g., prevent) movement of the mandrels 400, for example, from an upper position to a lower position.

While FIGS. 1A-1C, 2A, 3A-3B, and 5A-5B illustrate the dispenser 10 having three support frames 100, 200, 300, which form two vertical "bays" that can receive one or more tissue rolls (e.g., vertically), the dispenser 10 can include an alternative number of support frames 100, 200, 300 and/or combinations of the support frames 100, 200, 300 which form an alternative number of bays. For example, depending on the desired configuration for the dispenser 10, the dispenser 10 can include a single bay formed by one support frame 100 and one support frame 200 or formed by one support frame 200 and one support frame 300. Moreover, the number of mandrels 400 and levers 502 can be altered depending on the number of support frames 100, 200, 300. The amount and configuration of the support frames 100, 200, 300 and/or combinations thereof can be altered to achieve a desired amount of bays for the dispenser 10. Accordingly, while the discussion below is made with reference to a single "bay" dispenser including the support frames 200 and 300, the features of the support frames 200, 300 can be applicable in some or every respect to support frame 100 and/or to a dispenser including all of support frames 100, 200, 300, two mandrels 400, and two levers 502. Moreover, the cabinet 20, cover 30, and opening 12 can be modified depending on the number of support frames 100, 200, 300 employed in the dispenser 10.

Figures 6A, 6B:
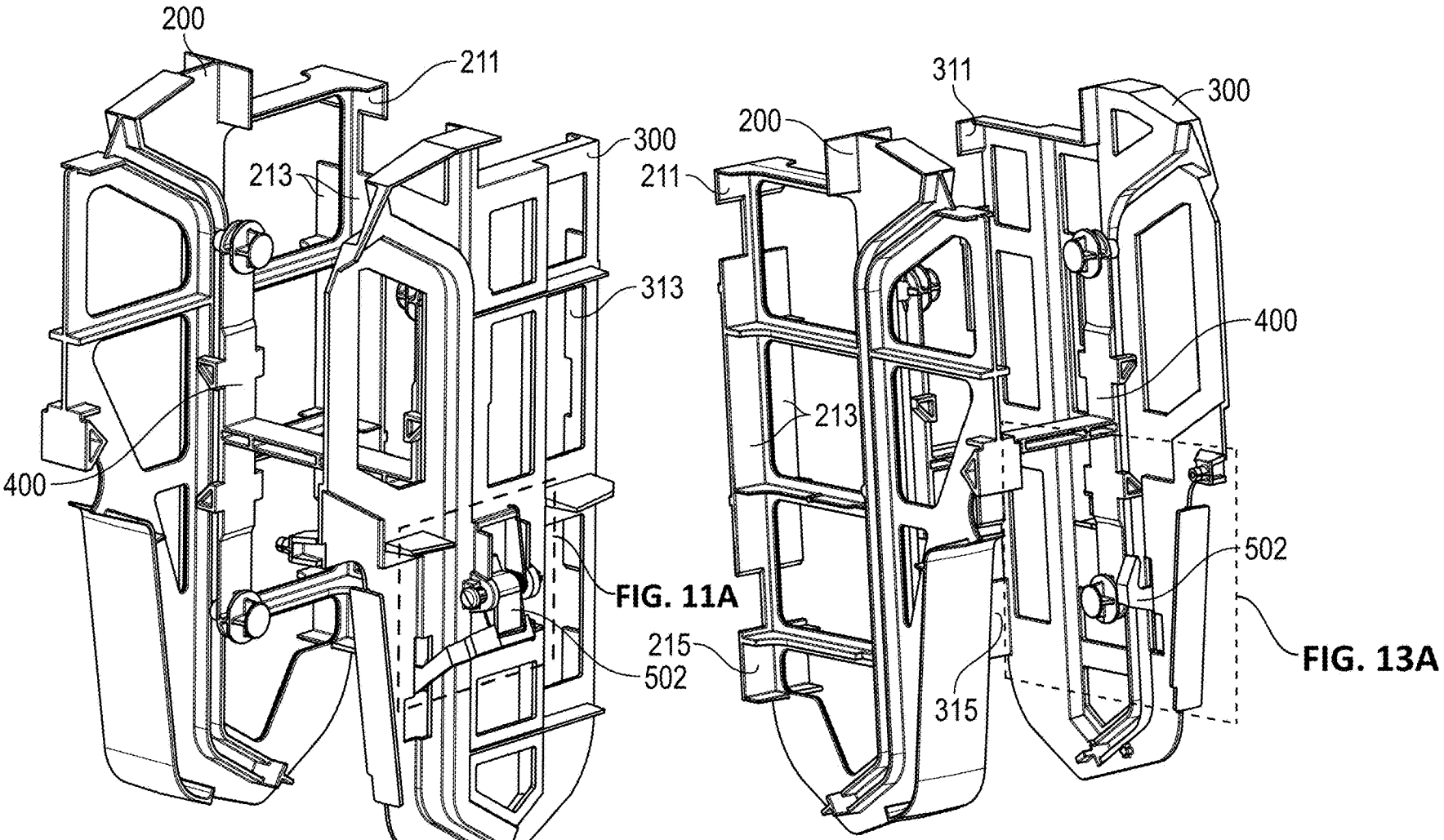
FIGS. 6A-6B illustrate perspective views of a portion of the tissue dispenser in accordance with aspects of this disclosure.
Figure 8B:
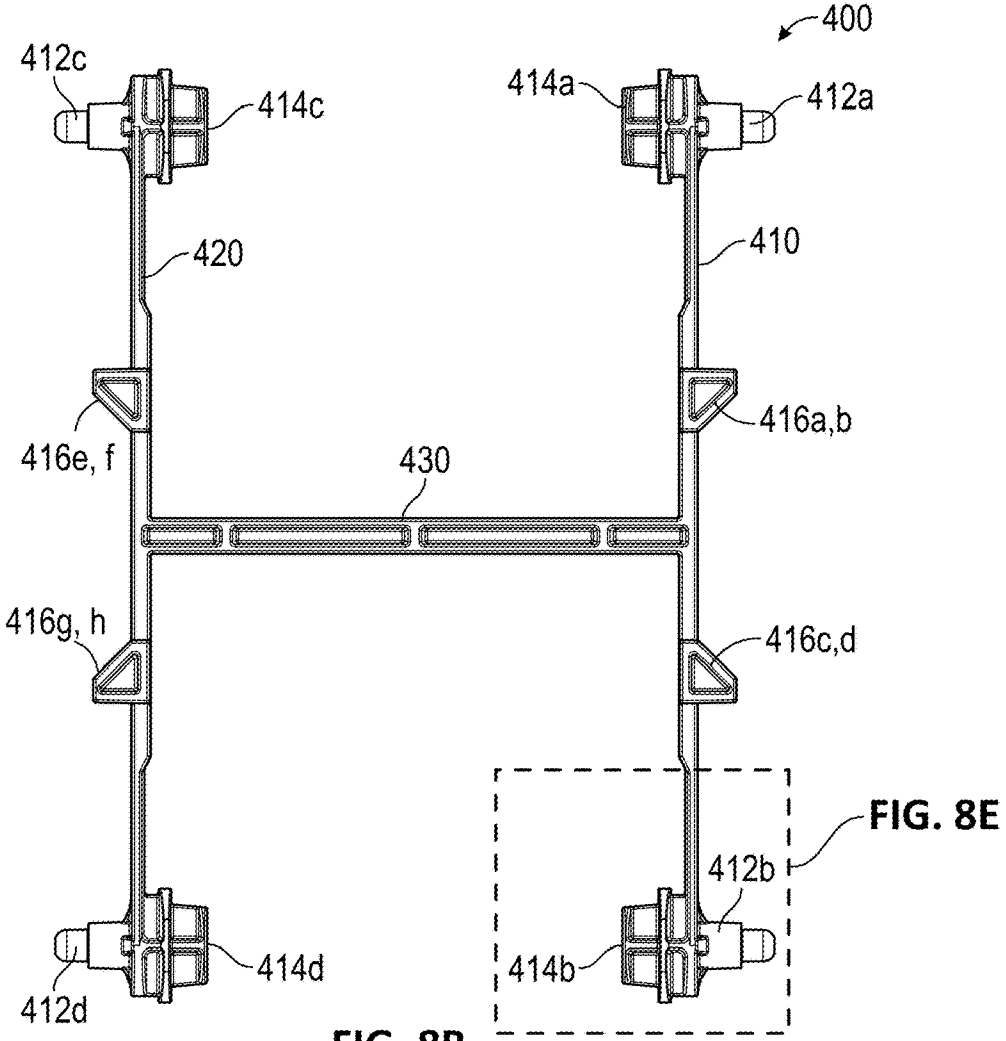
FIGS. 8A-8B illustrate views of a mandrel of the tissue dispenser.
Figure 8A:
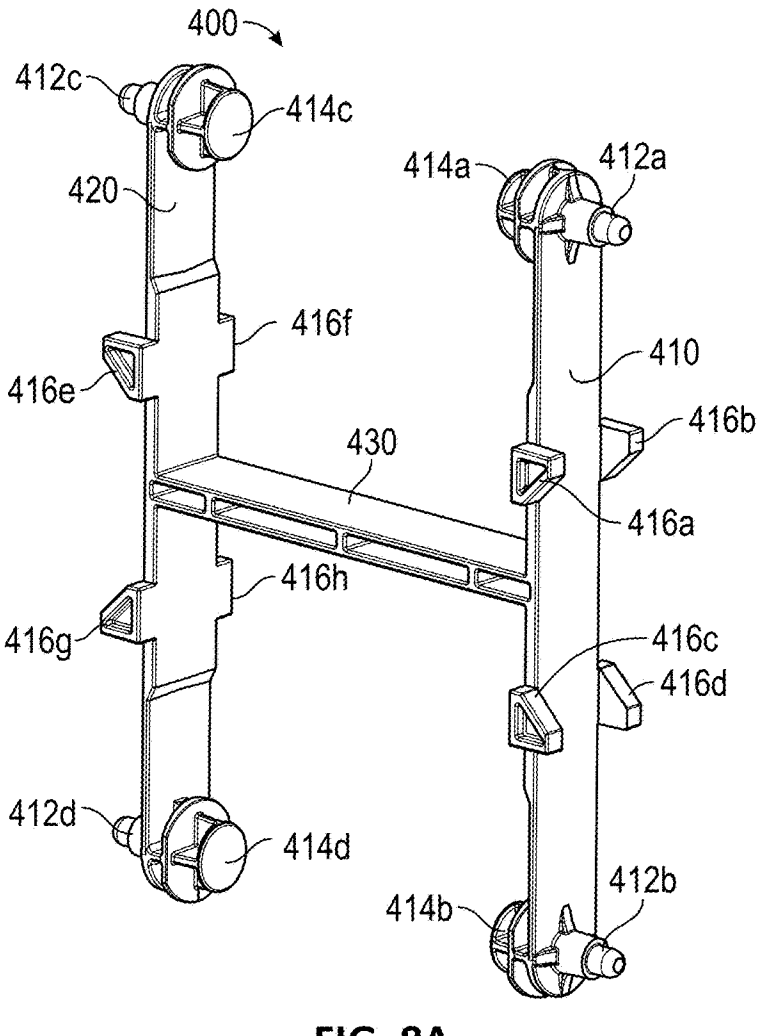

FIGS. 6A-6B illustrate a mandrel 400 positioned within a vertical "bay" within the support frames 200, 300 and further illustrate a lever assembly 500, secured to the support frame 300. FIGS. 7A-7B illustrate the support frames 200, 300 independent of the mandrel 400 and lever 502. FIGS. 8A-8E illustrate the mandrel 400 (and portions thereof) and FIGS. 9A-9C illustrate the lever 502 and a lever assembly 500 that can connect the lever 502 to the support frame 300. As discussed above, the support frames 200, 300 can include flanges, such as flanges 211, 213, 311, 313, 215, 315 that can secure to portions of the cabinet 20.

As discussed above, the mandrel 400 can be configured to hold one or more rolls of consumable material. As also discussed, the mandrel 400 can be movably connected to the support frames 200, 300. In some embodiments, a first (e.g., lower) roll is initially accessible by a user and movement of the mandrel 400 relative to the support frames 200, 300 can make a second (e.g., upper) roll accessible by the user. The support frames 200, 300 can include channels extending along some or all of the heights thereof. The channels can be sized and/or shaped to receive portions of the mandrel 400 to allow the mandrel 400 to move (e.g., slide) therewithin.

For example, as shown in FIGS. 7A-7B, the support frames 200, 300 can include channels 210, 310 extending along portions of heights thereof. In some embodiments, one or more of the channels are bound by protrusions. As shown, the channel 210 can be bound by rails protruding outward from a surface 201 of the support frame 200. In some embodiments, one or more of the channels are recessed in the support frame 300. For example, the channel 310 can be recessed from a surface 301*a* of the support frame 300. Some variants include a combination. For example, as shown, the channel 310 can be recessed from a surface 301*a* of the support frame 300 (see FIG. 7B) and can protrude outward from a second, opposite surface 301*b* of the support frame 300 (see FIG. 7A).

As shown in FIGS. 7A-7B, the channels 210, 310 can extend along a portion of heights of the support frames 200, 300. In some embodiments, the channels 210, 310 extend in a direction parallel to heights of the support frames 200, 300 (e.g., in a vertical direction) and extend in directions transverse (e.g., angled) relative to such parallel direction. For example, the channels 210, 310 can include generally vertical and/or straight portions 210*b*, 310*b* and angled portions 210*a*, 310*a* at or near ends thereof (e.g., at "top" ends). With reference to FIGS. 2A and 7A-7B, such angled portions 210*a*, 310*a* can be angled with respect to the straight portions 210*b*, 310*b* towards a "front" end of the dispenser 10, which can advantageously allow a user to more easily insert a mandrel 400 or portions thereof (e.g., the guides 412*a*-412*d*) into the channels 210, 310 of the support frames 200, 300 to fill or refill the dispenser 10 with tissue rolls. The angled portions 210*a*, 310*a* can be angled with respect to the straight portions 210*b*, 310*b* at a degree equal to about: 10°, 20°, 30°, 40°, 50°, 60°, 70°, 80°, or 90°, or any value therebetween, or any range bounded by any combination of these values, although values outside these ranges can be used in some cases.

In some embodiments, the channels 210, 310 include a widened entrance, which can advantageously provide for easier installation of the mandrel 400 or portions thereof into the channels 210, 310. For example, as shown in at least FIGS. 7A-7B, the channels 210, 310 can include angled or flared portions 210*d*, 310*d*. The flared portions 210*d*, 310*d* can be angled (e.g., "flared outward") with respect to the angled portions 210*a*, 310*a*. Such configuration can help guide and/or align portions of the mandrel 400 (for example, the guides 412*a*-*d*) into the channels 210, 310.

As shown in FIGS. 7A-7B, the channels 210, 310 of the support frames 200, 300 can include angled portions 210*c*, 310*c* at or near ends thereof (e.g., at "bottom" ends). Such angled portions 210*c*, 310*c* can be angled with respect to the straight portions 210*b*, 310*b* towards a "back" end of the tissue dispenser 10. Advantageously, such configuration can allow the mandrel 400 to move relative to the support frames 200, 300 (e.g., downward) closer to an opening of the dispenser 10 (such as opening 12) while reducing or minimizing the overall height of the dispenser 10 that would be required if the channels 210, 310 were oriented vertically. In some embodiments, such configuration, can allow a first (e.g., lower) tissue roll to be moved at least partially out of the way when at or near exhaustion so that a second (e.g., upper) tissue roll can be moved closer to the opening 12 of the dispenser 10. This in turn can provide better access to the second (upper) tissue roll for a user. The angled portions 210*c*, 310*c* can be angled with respect to the straight portions 210*b*, 310*b* at a degree equal to about: 10°, 20°, 30°, 40°, 50°, 60°, 70°, 80°, or 90°, or any value therebetween, or any range bounded by any combination of these values, although values outside these ranges can be used in some cases.

The support frames 200, 300 can include a stop that inhibits or prevents the mandrel 400 from moving relative to the support frames 200, 300 beyond a limit. For example, as shown in FIGS. 7A-7B, the support frames 200, 300 can include a flange 220, 320 extending from surfaces 201, 301*a* at or near bottom ends of the channels 210, 310. In some embodiments, the flanges 220, 320 extend generally perpendicular to surfaces 201, 301*a* and/or to the channels 210, 310. The flanges 220, 320 can block portions of the mandrel 400 from passing through the bottom ends of the channels 210, 310. For example, the flanges 220, 320 can block one or more of the guides 412*a*-412*d* from exiting through the bottom ends of the channels 210, 310. In some embodiments, the flanges 220, 320 are generally T-shaped (see FIG. 7A-7B).

Mandrel

FIGS. 8A-8E illustrate views of the mandrel 400 and portions thereof. The mandrel 400 can include a first stem 410, a second stem 420, and a cross-member 430 extending between and connected to the first and second stems 410, 420. In some embodiments, the cross-member 430 is generally perpendicular to the first stem 410 and/or second stem 420. In some embodiments, the first and second stems 410, 420 are generally parallel to one another. As illustrated, in some embodiments, the mandrel 400 is generally H-shaped.

The mandrel 400 can include one or more elements (e.g., protrusions) configured to secure and/or secure to rolls of consumable material (e.g., tissue rolls). For example, as shown in FIGS. 8A-8B, the mandrel 400 can include one or more stubs 414*a*, 414*b*, 414*c*, 414*d* which extend from portions of the stems 410, 420 and which can secure and/or secure to tissue rolls. The first stem 410 can include a first stub 414*a* extending from a portion of the first stem 410 and/or a second stub 414*b* extending from another portion of the first stem 410. The first stub 414*a* can be positioned at or near a first end of the first stem 410 and the second stub 414*b* can be positioned at or near a second end of the first stem 410. In some embodiments, one or both of the first or second stubs 414*a*, 414*b* can be positioned a distance away from the ends of the first stem 410. The first and second stubs 414*a*, 414*b* can extend from the same side of the first stem 410 in a direction towards the second stem 420, for example. The second stem 420 can include a first stub 414*c* extending from a portion of the second stem 420 and/or a second stub 414*d* extending from another portion of the second stem 420. The first stub 414*c* can be positioned at or near a first end of the second stem 420 and the second stub 414*d* can be positioned at or near a second end of the second stem 420. In some embodiments, one or both of the first or second stubs 414*c*, 414*d* can be positioned a distance away from the ends of the second stem 420. The first and second stubs 414*c*, 414*d* can extend from the same side of the second stem 420 in a direction towards the first stem 410, for example.

The stubs 414*a*, 414*b*, 414*c*, 414*d* can be configured to secure to tissue rolls having a "core" and/or "coreless" tissue rolls. In some embodiments, the stubs 414*a*, 414*b*, 414*c*, 414*d* are sized and/or shaped to fit within a core of a tissue roll, for example, within a cylindrical hollow paperboard core of a tissue roll. In some configurations, the stubs 414*a*, 414*b*, 414*c*, 414*d* can extend from surfaces of the stems 410, 420 and have ends that are sized to be received within ends of the paperboard core of the tissue roll. In some embodiments, the stubs 414*a*, 414*b*, 414*c*, 414*d* are sized and/or shaped to engage (for example, grip) sides or ends of coreless tissue rolls. For example, in some embodiments, the stubs 414*a*, 414*b*, 414*c*, 414*d* extend from surfaces of the stems 410, 420 and have ends which are tapered, pointed, or otherwise shaped to grip (or stick into) ends of the coreless tissue rolls. In some embodiments, the stubs 414*c*, 414*a* are aligned (e.g., vertically) with one another and/or stubs 414*d*, 414*b* are aligned (e.g., vertically) with one another (see FIG. 7B).

Figure 8C:
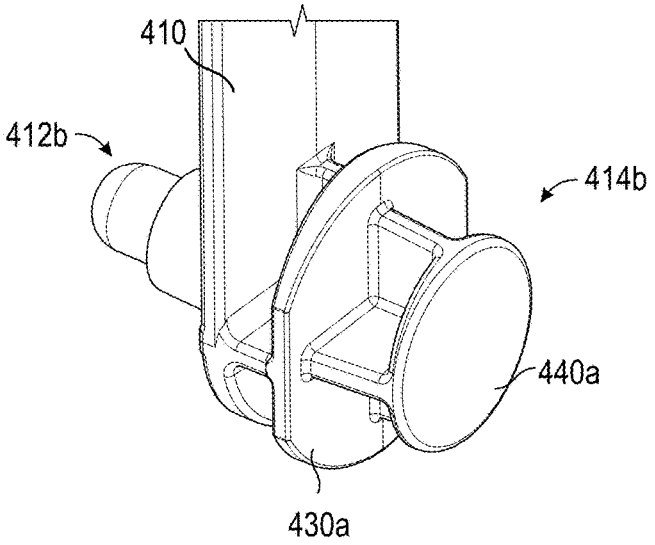
FIGS. 8C-8E illustrate enlarged views of portions of the mandrel of FIGS. 8A-8B.
Figure 8E:
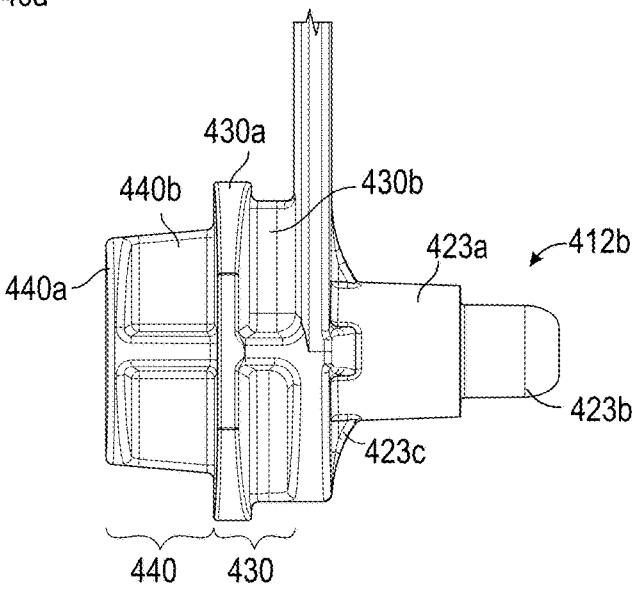
Figure 8D:
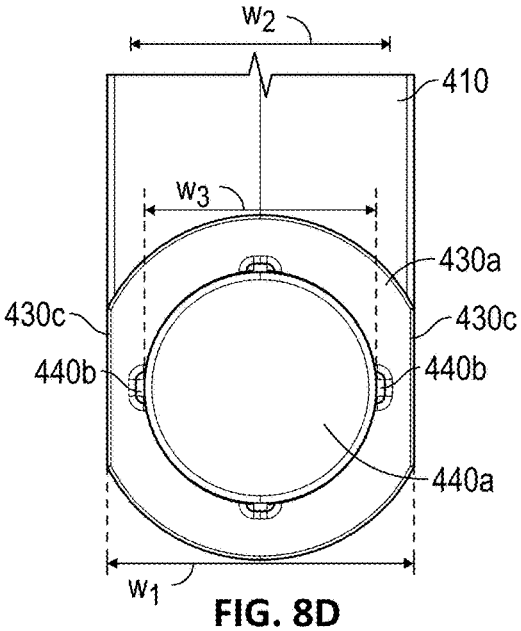
Figure 9B:
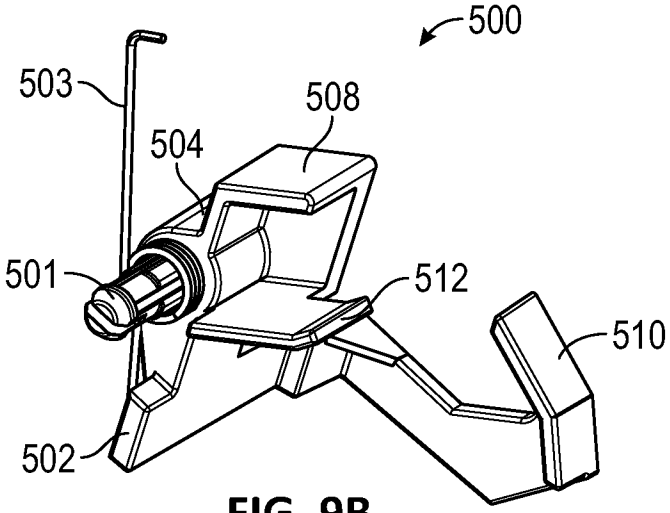
FIGS. 9A-9B illustrate various perspective views of a lever and a lever assembly of the tissue dispenser.

FIGS. 8C-8E illustrate enlarged views of the stub 414*b*, however, the features and description that follow can also be applicable to any of the stubs 414*a*, 414*d*, 414*c* and/or the first and second stems 410, 420. With reference to FIG. 8E, the stub 414*b* can include a base portion 430 extending from and/or connected to the first stem 410 and an engagement portion 440 extending from and/or connected to the base portion 430. The base portion 430 can include a plate 430*a* and one or more flange supports 430*b* that connect the plate 430*a* to the first stem 410. In some embodiments, the base portion 430 includes four flange supports 430*b* arranged in cross-shaped pattern. The engagement portion 440 can include a plate 440*a* and one or more flange supports 440*b* that connect the plate 440*a* to the plate 430*a* of the base portion 430. In some embodiments, the engagement portion 440 includes four flange supports 440*b* arranged in cross-shaped pattern. The engagement portion 440 can be sized and/or shaped to fit within a core of a tissue roll. In some embodiments, the plate 440*a* of the engagement portion 440 comprises a circular shape. In some embodiments, the plate 430*a* of the base portion 430 has a larger size and/or shape (e.g., a larger cross-section) than the plate 440*a* of the engagement portion 440. Such configuration can allow an end (for example, a cylindrical end) of a core of a tissue roll to rest against the plate 430*a* after passing over the engagement portion 440. In some embodiments, the plate 430*a* of the base portion 430 comprises a circular or partially circular shape. For example, with reference to FIG. 8D (as discussed in more detail below), the plate 430*a* can have a partially circular shape with two opposing straight sides 430*c*. As discussed further below, the straight sides 430*c* can advantageously allow a portion of the lever 502 (such as the first arm 510 of the lever 502) to sit adjacent to (e.g., "flush" with) and/or spaced from the base portion 430 (and/or plate 430*a*) which can minimize or eliminate interference between the lever 502 and the plate 430*a* when the lever 502 moves.

As discussed above, the mandrel 400 can be movably connected to the support frames 200, 300. As also discussed above, the mandrel 400 (and/or portions thereof) can be received within the channels 210, 310 of the support frames 200, 300, which allow the mandrel 400 to be moved, for example, vertically, with respect to the support frames 200, 300. The mandrel 400 can include one or more protrusions sized and/or shaped to fit within the channels 210, 310 of the support frames 200, 300 and which are configured to move (e.g., slide) within such channels 210, 310. For example, as shown in FIGS. 8A-8B, the mandrel 400 can include guides 412*a*, 412*b*, 412*c*, 412*d* which can be sized and/or shaped to fit within the channels 210, 310.

As shown, the first stem 410 can include a first guide 412*a* extending from a portion of the first stem 410 and/or a second guide 412*b* extending from another portion of the first stem 410. The first guide 412*a* can be positioned at or near a first end of the first stem 410 and the second guide 412*b* can be positioned at or near a second end of the first stem 410. In some embodiments, one or both of the first or second guides 412*a*, 412*b* can be positioned a distance away from the ends of the first stem 410. The first and second guides 412*a*, 412*b* can extend from the same side of the first stem 410 in a direction away from the second stem 420, for example. The guides 412*a*, 412*b* can extend from the first stem 410 in a direction opposite to the direction of extension of the stubs 414*a*, 414*b* discussed above. In some embodiments, the guides 412*a*, 412*b* are aligned (e.g., vertically) with the stubs 414*a*, 414*b* (see FIG. 8B).

As also shown, the second stem 420 can include a first guide 412*c* extending from a portion of the second stem 420 and/or a second guide 412*d* extending from another portion of the second stem 420. The first guide 412*c* can be positioned at or near a first end of the second stem 420 and the second guide 412*d* can be positioned at or near a second end of the second stem 420. In some embodiments, one or both of the first or second guides 412*c*, 412*d* can be positioned a distance away from the ends of the second stem 420. The first and second guides 412*c*, 412*d* can extend from the same side of the second stem 420 in a direction away from the first stem 410, for example. The guides 412*c*, 412*d* can extend from the second stem 420 in a direction opposite to the direction of extension of the stubs 414*c*, 414*d* discussed above. In some embodiments, the guides 412*c*, 412*d* are aligned (e.g., vertically) with the stubs 414*c*, 414*d* (see FIG. 8B).

As discussed above, the guides 412*a*, 412*b*, 412*c*, 412*d* can be sized and/or shaped to fit within the channels 210, 310. In some embodiments, the "free" ends of the guides 412*a*, 412*b*, 412*c*, 412*d* are rounded and/or have circular cross-sections. Such configuration can help the guides 412*a*, 412*b*, 412*c*, 412*d* (and in turn, the mandrel 400) more easily move (e.g., slide) within the channels 210, 310. Such configuration can also more easily allow the mandrel 400 to move within and/or transition between the angled portions 210*a*, 310*a*, 210*c*, 310*c* and the straight portions 210*b*, 310*b*. FIGS. 8C-8E illustrate enlarged views of the guide 412*b*, however, the features described with reference to these figures can be equally applicable to the guides 412*a*, 412*c*, 412*d* and first and second stems 410, 420. As shown, in some embodiments, the guide 412*b* includes a base portion 423*a* connected to and extending from the first stem 410 and an engagement portion 423*b* connected to and extending from the base portion 423*a*. In some embodiments, the engagement portion 423*b* comprises a smaller cross-section than the base portion 423*a*. Such configuration can allow an end of the base portion 423*a* to sit against edges of the channels 210, 310 when the engagement portion 423*b* is positioned within the channels 210, 310. In some embodiments, the base portion 423*a* is supported by one or more flanges 423*c* extending from the first stem 410 and connected to the base portion 423*a*.

The mandrel 400 can include one or more of flanges 416. As shown, the mandrel 400 can include a plurality of flanges, such as eight 416*a*-416*h*. Other numbers of flanges are contemplated, such as one, two, three, four, five, six, seven, or more. The flanges 416 can extend from the stems 410, 420 of the mandrel 400. In some embodiments, the flanges 416 comprise a triangular shape (such as a right-triangular shape). The flanges 416*a*-416*h* can extend outward from the stems 410, 420 and/or along side edges of the stems 410, 420. In some embodiments, the flanges 416 are spaced outward from an interior of the stems 410, 420. For example, the flanges 416 can be positioned along side edges of stems 410, 420 and spaced outward from the one or more guides 412*a*-414*d* (see FIG. 8A). Such positioning advantageously allows the flanges 416 to be positioned outward from the channels 210, 310 of the support frames 200, 300 so as to not interfere with the mandrel's 400 ability to move along the channels 210, 310 (see, e.g., FIGS. 6A-6B).

In some embodiments, the mandrel 400 is configured to facilitate engagement with the support frame 300. For example, in some embodiments, the mandrel 400 is configured to be received in the support frame 300 in the orientation shown in FIG. 8B, or rotated 180 degrees about a vertical axis, or rotated 180 degrees about a horizontal axis. In certain variants, the mandrel 400 and/or the arrangement of the flanges 416 is symmetrical about a vertical axis and/or a horizontal axis. In some implementations, the mandrel 400 includes the flanges 416*a*-416*h*. Such configuration can ensure that at least one of the flanges 416*a*-416*h* interacts with the lever 502 regardless of the direction and/or orientation that the mandrel 400 is installed in the channels 210, 310 of the supports frames 200, 300. In some implementation, the dispenser 10 has more flanges 416 than mandrels 400 and/or levers 502, such as a single lever 502 and a mandrel 400 with a plurality of the flanges 416.

As will be discussed in more detail below, the one or more flanges 416 can be configured to engage (e.g., contact) the lever 502 when the lever 502 is in a first position or mode (e.g., rotational position). In various embodiments, the engagement between the lever 502 and the flange 416 of the mandrel 400 provides a physical interference that stops the mandrel 400 from sliding from an upper position to a lower position, relative to the support frames 200, 300 and/or the opening 12.

Lever Assembly

As mentioned above, and with reference to FIGS. 9A-9C, the dispenser 10 can include a lever assembly 500. The lever assembly 500 can be configured to interact with the mandrel 400 to control movement of the mandrel 400 with respect to the support frames 200, 300. For example, as discussed in more detail below, in a first mode, the lever assembly 500 can be configured to at least partially inhibit (or prevent) movement of the mandrel 400 with respect to the support frames 200, 300 and in a second mode, the lever assembly 500 can be configured to permit movement of the mandrel 400 with respect to the support frames 200, 300. For example, in the first mode, the lever assembly 500 can inhibit movement of the mandrel 400 along the channels 210, 310 of the support frames 200, 300.

The lever assembly 500 can include a pin 501, a lever 502, and/or a biasing member 503. The pin 501 and the biasing member 503, and the discussion that follows related to these components, are an illustrative mechanism for coupling the lever 502 to the support frame 300. However, this mechanism is not intended to be limiting. The lever 502 can be secured (e.g., movably) to the support frame 300 via a different mechanism or technique and still interact with the mandrel 400 and/or tissue rolls secured thereto in the same or similar manner as that described below.

As shown, the lever 502 can include a first arm 510, a second arm 508, and a body 504. The arms 508, 510 can be rigidly connected and/or configured to move as a unit. As discussed in more detail below, the first arm 510 can be a sensor and/or the second arm 508 can be a controller. For example, the first arm 510 can be configured to contact a side or end of a tissue roll coupled to the mandrel 400 and to detect a characteristic of the tissue roll, such as outside diameter. As another example, the second arm 508 can be configured to engage or disengage a portion of the mandrel 400 to control movement of the mandrel 400, such as between an upper and lower position. The lever 502 can include an opening 505. The opening 505 can be a recess or through-hole that is sized and/or shaped to receive the pin 501.

Figure 9D:
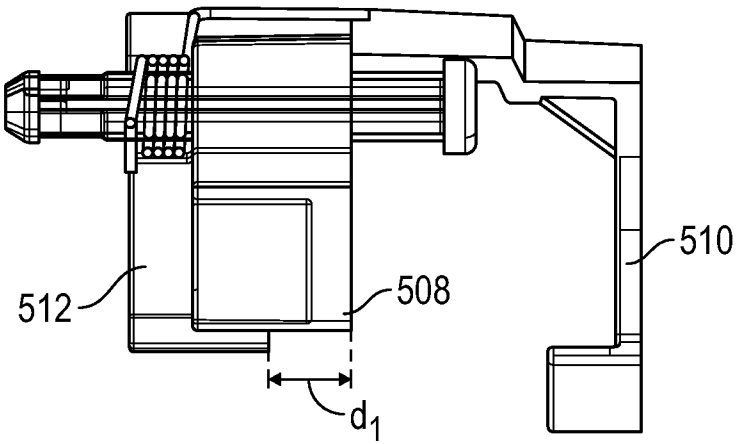
FIG. 9D illustrates a top view of the lever assembly of FIGS. 9A-9B.
Figure 9A:
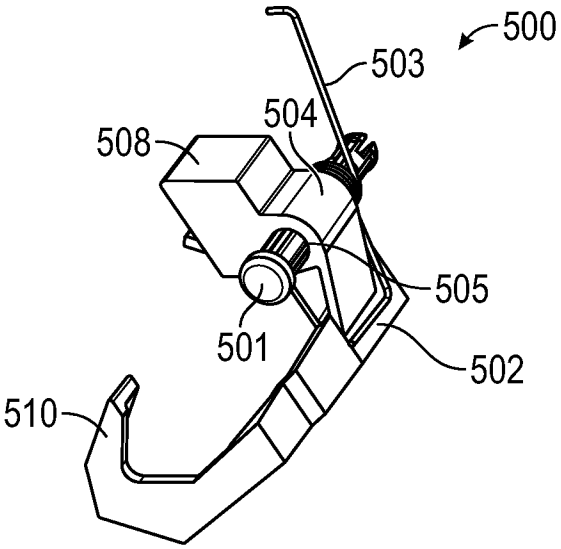
Figure 9C:
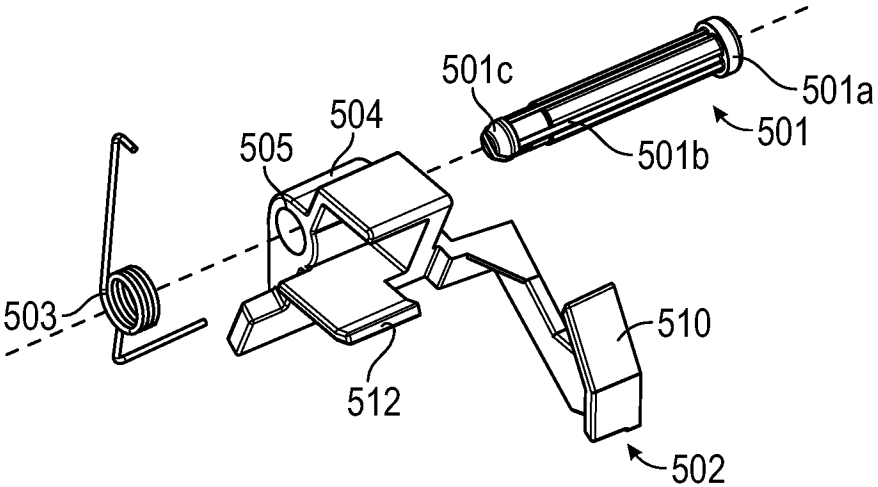
FIG. 9C illustrates an exploded perspective view of the lever assembly of FIGS. 9A-9B.

In some embodiments, the lever 502 includes a flange 512 (see FIGS. 9B-9D). As illustrated, the flange 512 can have an angled and/or cantilevered end. As shown by at least FIG.

9D which illustrates a top view of the lever assembly 500, the flange 512 (or a portion thereof) can be offset from the arm 508. For example, in some variants, a width of the flange 512 is offset from a width of the arm 508. In some variants, an end or edge of the flange 512 is spaced from an end of edge of the arm 508 by a distance $d_1$ (see FIG. 9D). In some variants, the distance $d_1$ is sized to accommodate a width of one of the flanges 416 of the mandrel 400 (e.g., flange 416*d* of mandrel 400). For example, the distance $d_1$ can be greater than or equal to a width of one or more of the flanges 416 of the mandrel 400 (for example, greater than or equal to a width of flange 416*d*). Incorporating an offset from an end or edge of the flange 512 from an end of edge of arm 508 (see FIG. 9D) can advantageously allow the flange 512 to not interfere with one or more of the flanges 416 of the mandrel 400 (e.g., the flange 416*d*) when the mandrel 400 is moving within at least a portion of the channels 310 (e.g., within the straight portion 310*b* of the channel 310). Additionally, as discussed further below with reference to FIGS. 14A-15B, by engaging one of the flanges 416 of the mandrel 400 when the mandrel 400 moves within the angled portion 310*c*, the flange 512 can help the lever 502 move so that the arm 510 does not interfere with an upper tissue roll (such as upper tissue roll 2). For example, as discussed further below, by contacting the flange 416*b* when the mandrel 400 moves through the angled portion 310*c* of the channel 310, the flange 512 can advantageously cause the lever 502 to move (e.g., rotate) so that the arm 510 does not contact a portion of the upper tissue roll 2.

Figure 10B:
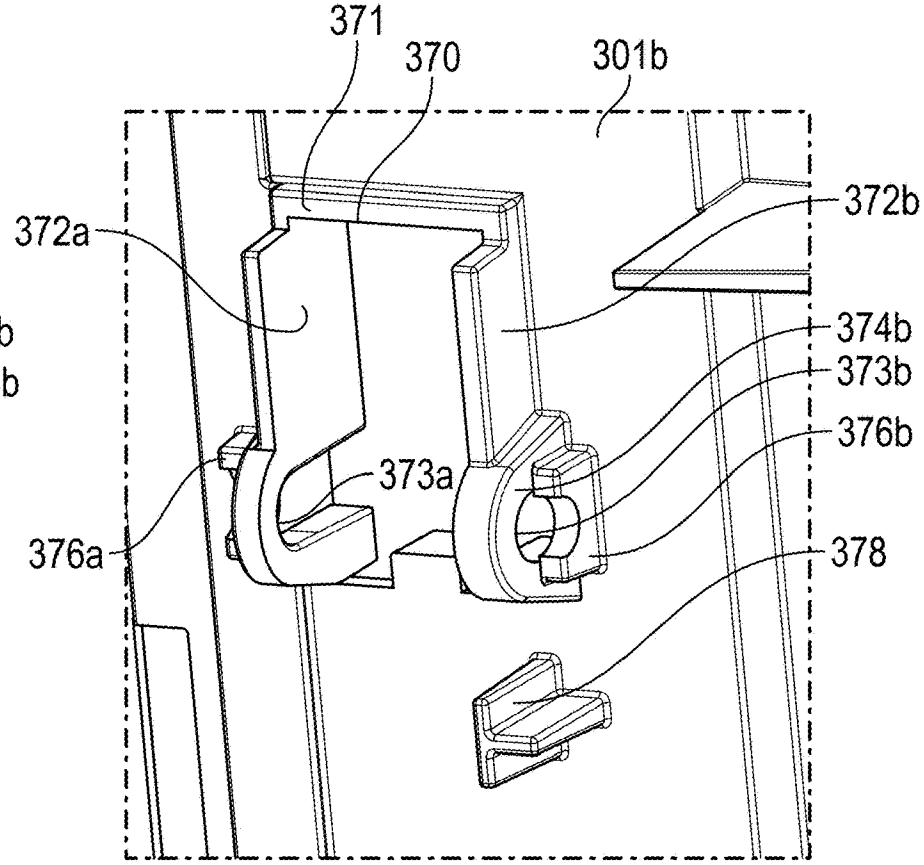
FIG. 10B illustrates an additional perspective view of the portion of the support frame shown in FIG. 10A.
Figure 10A:
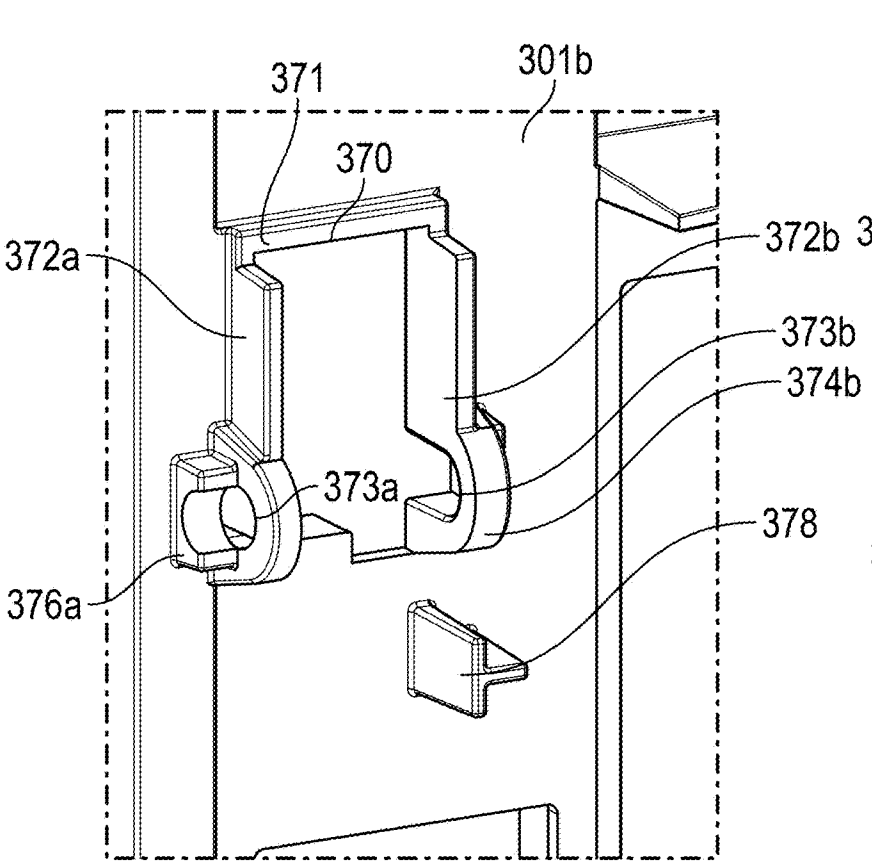
FIG. 10A illustrates an enlarged view of a portion of one of the support frames shown in FIG. 7A.

FIGS. 10A-11B illustrate the connection between the lever assembly 500 and the support frame 300. FIGS. 10A-10B illustrate an enlarged portion of the support frame 300 shown in FIG. 7A (the lever assembly 500 is not shown in these figures). The support frame 300 can include an opening 370, such as a through hole. The frame 300 can include a lip 371 extending from the surface 301*b* of the support frame 300 along an end (or on "top") of the opening 370, and/or sidewalls 372*a*, 372*b* extending from the surface 301*b* along sides of the opening 370. The sidewalls 372*a*, 372*b* can include openings 373*a*, 373*b* at or near ends thereof. The openings 373*a*, 373*b* can be at least partially shaped to receive the pin 501 of the lever assembly 500. The support frame 300 can include walls 376*a*, 376*b* extending from the surface 301*b* adjacent the sidewalls 372*a*, 372*b* (for example, positioned outside the sidewalls 372*a*, 372*b*). The walls 376*a*, 376*b* can include recessed portions that are sized and/or shaped to generally conform to a size and/or shape of the pin 501 of the lever assembly 500. In some embodiments, the openings 373*a*, 373*b* comprise an arch-shape (FIGS. 10A-10B). In some embodiments, the walls 376*a*, 376*b* comprise an arch-shape (FIGS. 10A-10B).

Figure 11B:
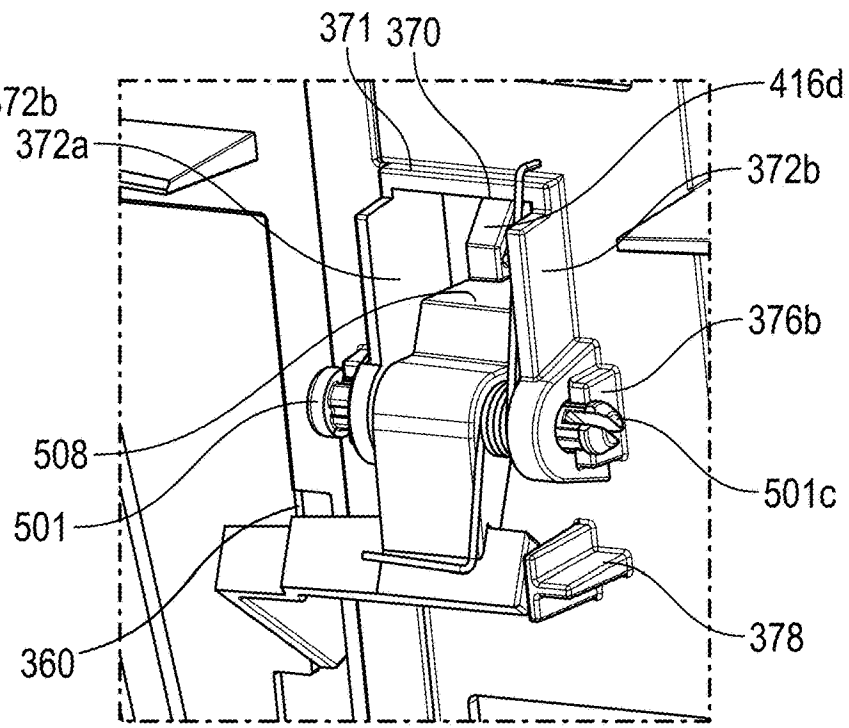
FIG. 11B illustrates an additional perspective view of the portion of the support frame and lever assembly shown in FIG. 11A.
Figure 11A:
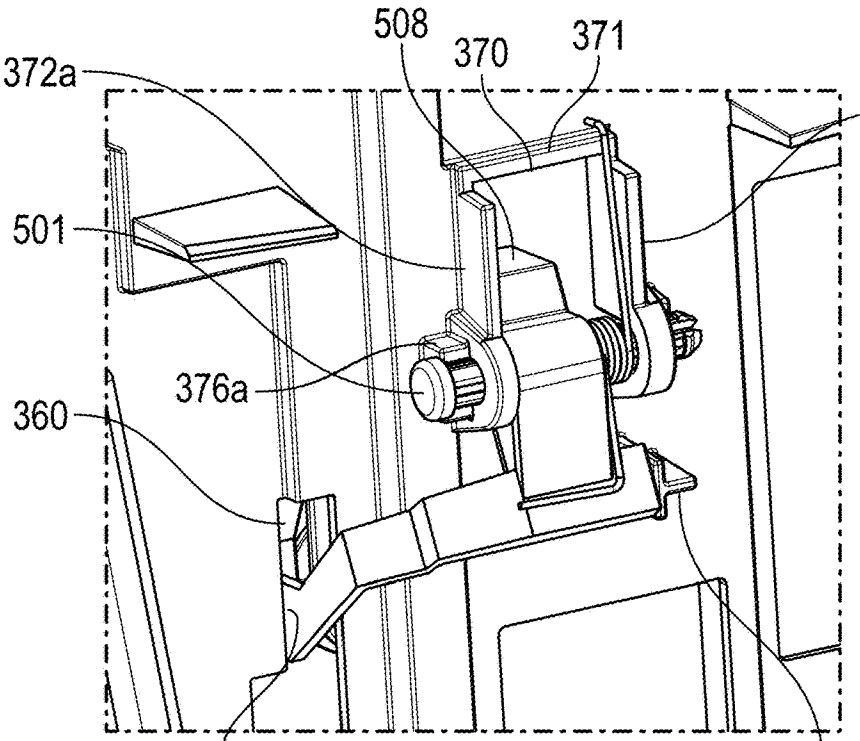
FIG. 11A illustrates an enlarged view of a portion of one of the support frames and lever assembly illustrated in FIG. 6A.

FIGS. 11A-11B illustrate the same enlarged portion of the support frame 300 shown in FIGS. 10A-10B with the lever assembly 500 secured thereto. As shown, the pin 501 can extend through the opening 505 in the body 504 of the lever 502, through the openings 373*a*, 373*b*, and can fit at least partially in the space defined by the recessed portions of the walls 376*a*, 376*b*. In some embodiments, the opposing arch-shapes of the walls 376*a*, 376*b* and the openings 373*a*, 373*b* restrict movement of the pin 501 in a direction perpendicular to the surface 301*b* of the support frame 300. With reference to FIGS. 9A-9C and 11B, the pin 501 can include a resilient, two-pronged tip 501*c* with a tapered end that is configured to contract upon insertion through openings 373*a*, 373*b* and the recessed portion of walls 376*a*, 376*b* and expand thereafter to lock the pin 501 in place (e.g., horizontally) against a surface of the wall 376*b*. The pin 501 can include a head 501*a* having a greater cross-section than a body 501*b* of the pin 501 to also restrict horizontal movement of the pin 501 via contact against a surface of the wall 376*a*.

When secured to the support frame 300 as discussed above, the lever 502 can rotate with respect to the support frame 300, for example, about an axis extending through the pin 501. The biasing member 503 can be provided to help bias the lever 502 to a neutral (e.g., "unstressed" or "resting") position with respect to the support frame 300. In some embodiments, the biasing member 503 is a spring, such as a torsional spring. The biasing member 503 can be positioned around the pin 501 and can engage a portion of the support frame 300 and a portion of the lever 502. For example, an end of the biasing member 503 can be configured to engage the lip 371 which extends from the surface 301*b* along the opening 370 and can also engage a portion of the body 504 of the lever 502 (see FIGS. 11A-11B). In some embodiments, the biasing member 503 can bias the lever 502 towards the neutral position, such that, if a force is applied to the lever 502 (such as to the first arm 510 of the lever 502) to move the lever 502 from this neutral position, a force (e.g., spring force) is imposed on the biasing member 503. As discussed in more detail below, such induced biasing force can advantageously cause the lever 502 to move back to its neutral position so that the second arm 508 of the lever 502 does not inhibit the mandrel 400 from moving (e.g., vertically) to a lower position. Such biasing can allow the lever 502 to automatically move back to its neutral position, thus allowing the mandrel 400 to, in turn, automatically drop down to provide access to an upper tissue roll held by the mandrel 400.

Figure 13A:
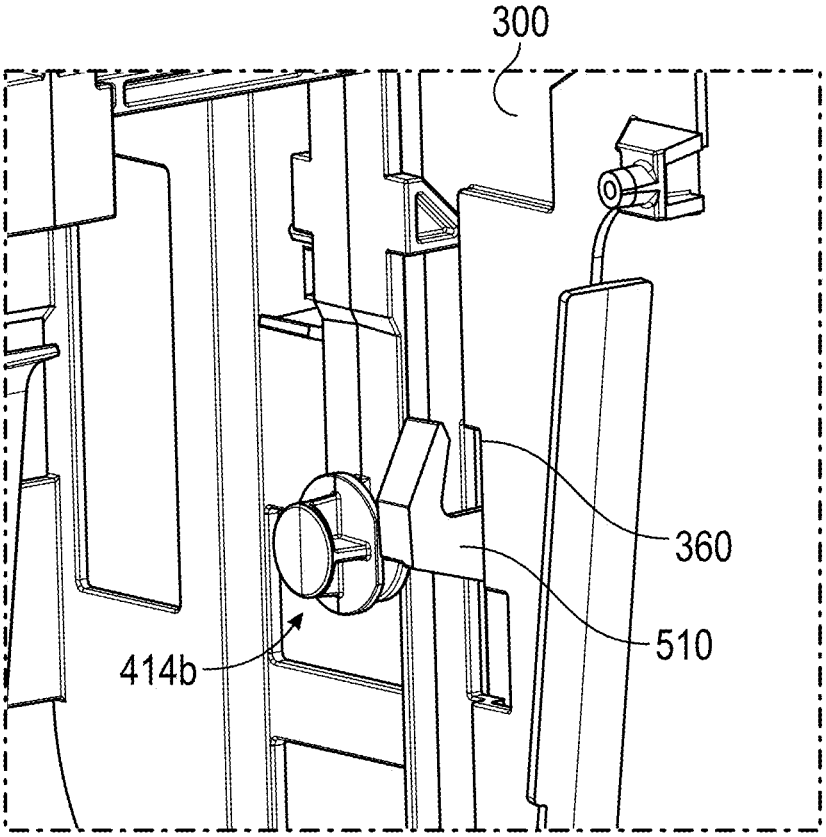
FIG. 13A illustrates an enlarged view of a portion of the tissue dispenser shown in FIG. 6B.
Figure 13B:
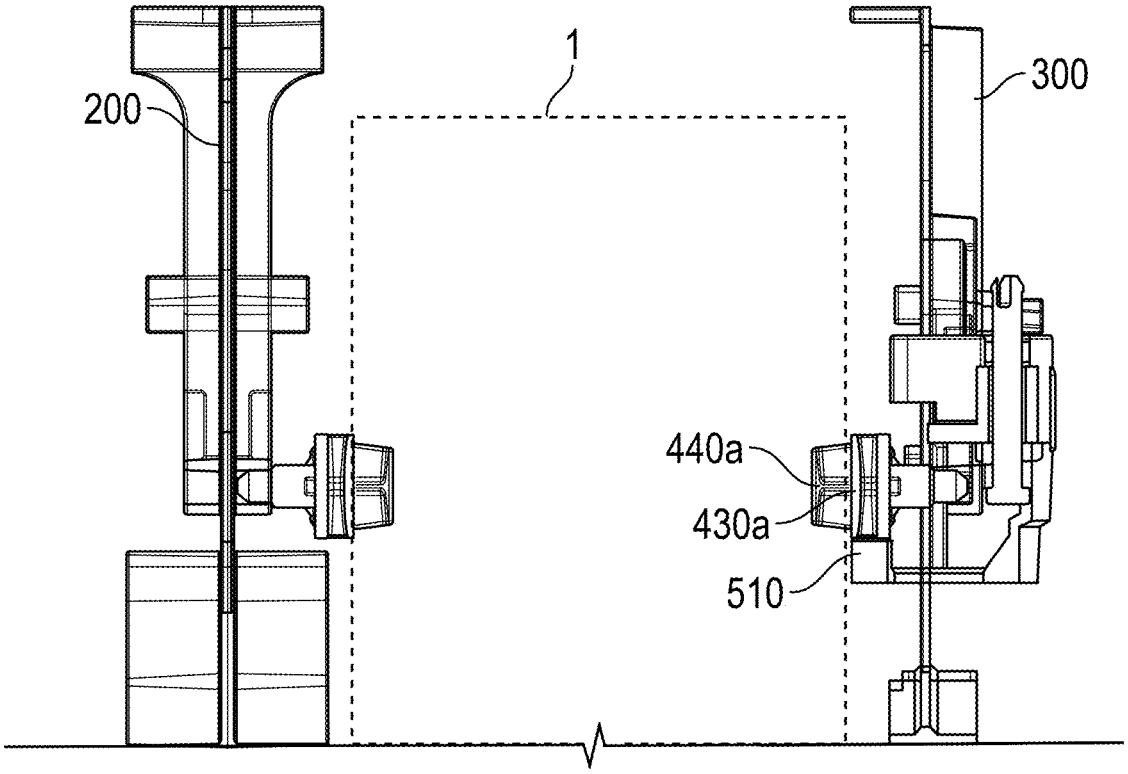
FIG. 13B illustrates a top view of a portion of the tissue dispenser shown in FIG. 12A.

As shown in FIGS. 11A-11B, the support frame 300 can include a guide flange 378 extending from the surface 301*b* of the support frame 300 which can help alignment of the lever 502 within the openings 370 and/or 360 during assembly along with the pin 501 and the biasing member 503. In some embodiments, the guide flange 378 is generally T-shaped. As also shown, the opening 360 in the support frame 300 can be sized and/or shaped to allow the first arm 510 of the lever 502 to pass and/or move therethrough. In some variants, the guide flange 378 can advantageously help control a movement and/or rotation of the lever 502 so as to maintain a minimal clearance between the first arm 510 of the lever 502 and the straight sides 430*c*, which is discussed elsewhere herein (e.g., see discussion with reference to FIGS. 13A-13B).

Operation of the Dispenser

Figure 12C:
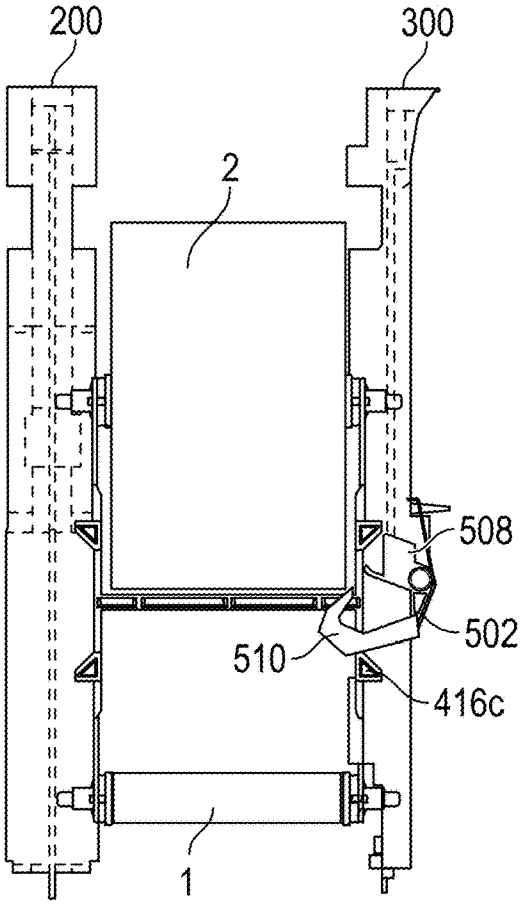
FIGS. 12A-12C illustrate front views of a portion of the tissue dispenser and further illustrate the mandrel and lever moving between two positions in accordance with the aspects of this disclosure.
Figure 12B:
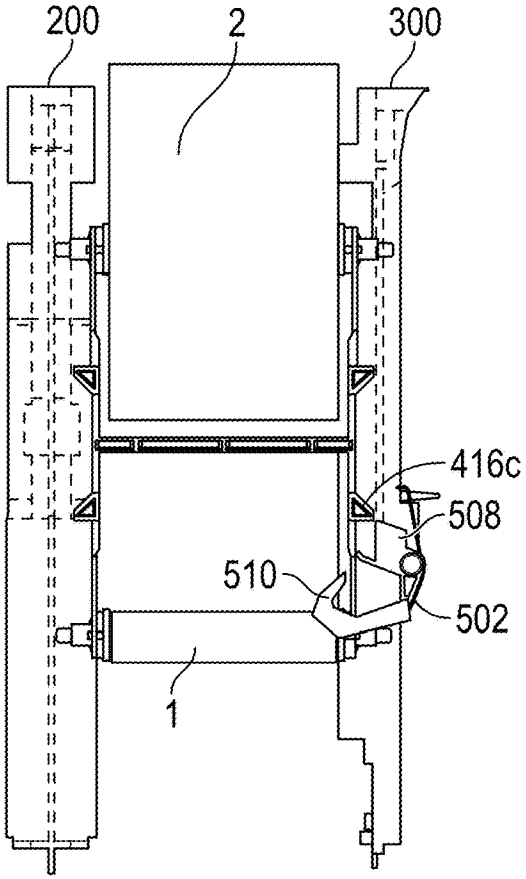
Figure 12A:
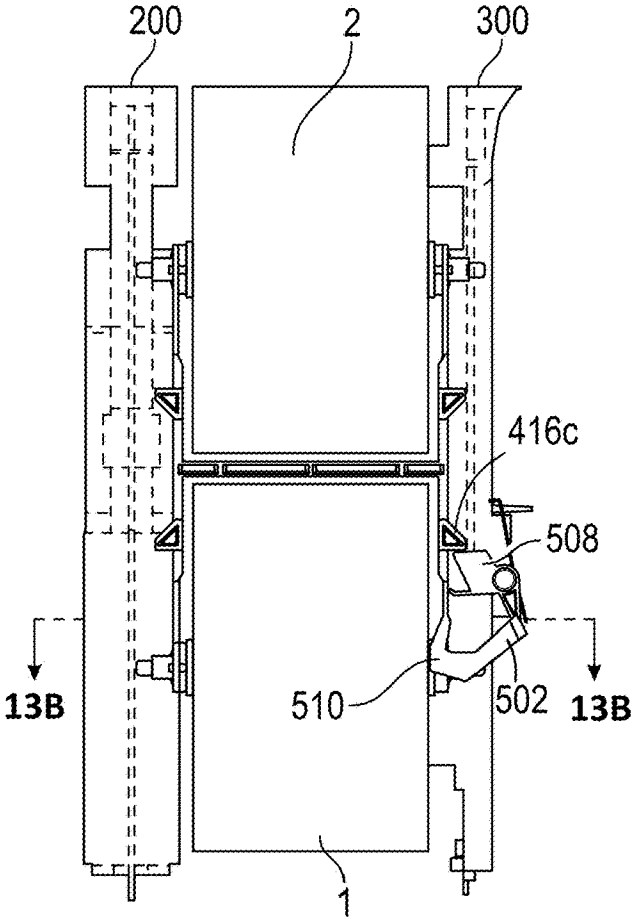

FIGS. 12A-12C illustrate an embodiment of the dispenser 10 in various modes of operation. For example, these figures illustrate how the mandrel 400 can move (e.g., "automatically") between the upper and lower positions with respect to the support frames 200, 300, for example, within the interior of the dispenser 10. In FIGS. 12A-12C, (front) portions of the support frames 200, 300 are shown in dotted lines to better illustrate the mandrel 400, lever 502, and portions thereof.

FIG. 12A illustrates a first mode of operation of the dispenser 10, such as near the time the dispenser 10 was stocked with two full tissue rolls, a lower roll 1 and an upper roll 2. This figure illustrates a front view of the support frames 200, 300, the lever 502 (secured to the support frame 300 as described above), the mandrel 400, and lower and upper tissue rolls 1, 2 secured to the mandrel 400 (for example, secured to and/or between stubs 414*a*, 414*b*, 414*c*, 414*d*). When the lower tissue roll 1 is positioned as shown in FIG. 12A, the lower tissue roll 1 (e.g., due to its outside diameter and/or axial length) can push the lever 502 away from its neutral (e.g., biased) position. In such position, the first arm 510 of the lever 502 can contact an end of the lower tissue roll 1 and the second arm 508 of the lever 502 can contact (and, for example, physically block) a portion of the mandrel 400, such as the flange 416*c* where the mandrel 400 is oriented as shown in FIGS. 8A-8B. In the embodiment illustrated, the flange 416*c* is blocked, but other embodiments and/or orientations of the mandrel 400 can block other flanges.

As the lower tissue roll 1 is used (e.g., dispensed to users), its outside diameter decreases. This, in turn, allows the first arm 510 to move inward (e.g., in a direction towards the support frame 200) and allows the lever 502 to move to its neutral (e.g., biased) position. Movement of the first arm 510 in such manner can cause the second arm 508 to move relative to the flange 416, such as toward the right in the illustrated embodiment. The second arm 508 can move (e.g., slide) toward a position out of engagement with the flange 416.

In certain embodiments in which the lever 502 is rotatably secured to the support frame 300 (for example, via the pin 501 and the biasing member 503), exhaustion of a diameter of the lower tissue roll 1 beyond a given threshold removes the physical obstacle resulting from the presence of the lower tissue roll 1 adjacent the first arm 510, which allows the lever 503 to rotate to its neutral position defined by the biasing member 503. Such exhaustion of the diameter of the roll 1 beyond the threshold thus also removes the physical interference resulting from the location of the second arm 508 relative to the flange 416*d*. Such movement of the lever 502 can remove the second arm 508 from a path (e.g., a generally vertical path) of the flange 416*d*.

Eventually, through continued dispensation, the lower roll 1 becomes so small so that the second arm 508 moves completely out of engagement with the flange 416. FIG. 12B illustrates this intermediate position of the mandrel 400 at the moment when the physical interference caused by the second arm 508 is removed. As shown, in some embodiments, as the second arm 508 moves (e.g., rotates) out of the way of the flange 416*d*, the second arm 508 can push the flange 416*d* (and thus the mandrel 400) slightly upward, which can be seen by a comparison of the vertical position of the mandrel 400 in FIGS. 12A and 12B.

After the second arm 508 is moved away from (e.g., out of a movement path of) the flange 416*d*, the mandrel 400 can move to a lower position, as illustrated in FIG. 12C. For example, the mandrel 400 can automatically move (e.g., drop generally vertically, such as due to gravity) downward. When the mandrel 400 is in the lower position (FIG. 12C), the upper tissue roll 2 can be accessible (or more accessible) to a user, for example, via the opening 12 of the dispenser 10. In some embodiments, when the mandrel 400 is in the lower position, guides of the mandrel 400 (such as guides 412*b*, 412*d*) are positioned within the angled portions 210*c*, 310*c* of the channels 210, 310 of the support frames 200, 300 and/or adjacent to flanges 220, 320.

As discussed above, movement of the mandrel 400 from the upper position to the lower position can be initiated or occur when a condition is satisfied. The condition can be that the lower tissue roll 1 is exhausted a certain amount, for example, when a diameter of the lower tissue roll 1 falls below a given threshold (e.g., less than approximately 25 mm). In various embodiments, the condition is satisfied before the lower roll 1 is completely exhausted. The mostly, but not completely, exhausted lower roll can be called a "stub roll." In certain implementations, the dispenser 10 is configured to dispense and/or allow a user to access the stub roll 1 and the upper roll 2, such through the opening 12.

In some implementations, the mandrel 400 can be configured to facilitate movement relative to the lever assembly 500. For example, the stubs 414*d* and 414*b* of the mandrel 400 can be configured to ease passage of the mandrel 400 past the arm 510. In some cases, when the lever 502 is secured to the support frame 300 as discussed above, the first arm 510 of the lever 502 is positioned adjacent the stub 414*b* of the mandrel 400 (see FIGS. 13A-13B). In some such cases, when a cross-sectional area of the lower tissue roll 1 is depleted an amount such that it is equal to or less than a cross-sectional area of the stub 414*b* (or a portion thereof), the lower tissue roll 1 can cease to block the first arm 510 and the first arm 510 can move (e.g., rotate) as discussed above. For example, with reference to FIG. 8D, where the stub 414*b* includes the base portion 430, when a diameter of the lower tissue roll 1 is equal to or less than the width $w_1$ between sides 430*c* of the plate 430*a* of the base portion 430, the first arm 510 of the lever 502 can move to the neutral position as discussed above. As another example, with continued reference to FIG. 8D, where the stub 414*b* includes the plates 430*a*, 440*a*, and the one or more stems 440*b*, when a diameter of the lower tissue roll 1 is between widths $w_1$, $w_3$ or between widths $w_1$ and $w_2$, the first arm 510 of the lever can move to the neutral position as discussed above. As discussed above with reference to FIG. 8D, in some embodiments, the plate 430*a* of the base portion 430 includes straight sides 430*c* that can allow the first arm 510 of the lever 502 to sit adjacent (e.g., "flush") against or spaced from the plate 430*a* and allow the lever 502 to move adjacent the plate 430*a* with little or no interference (e.g., contact) with the plate 430*a* (e.g., compared to a configuration without the straight sides 430*c*).

As discussed above, the mandrel 400 can move relative to the support frames 200, 300 between an upper position and a lower position, for example, via movement of the guides 412 within the channels 210, 310. As also discussed, movement of the mandrel 400 to the lower position can provide access to an upper tissue roll 2. With reference to FIG. 12C, in some cases, when the lever 502 moves to a neutral position (discussed above), the arm 510 of the lever 502 may contact a portion of the upper tissue roll 2 (e.g., a bottom right corner of the upper tissue roll 2). Such contact may cause excess drag when a user retrieves a length of the upper tissue roll 2. This excess drag can in turn make retrieval more difficult and/or may cause inadvertent tearing of the product retrieved from the roll 2. As discussed above, the lever 502 can include a flange 512 that can engage a portion of the mandrel 400 and cause the lever 502 to move (e.g., rotate) such that contact between the arm 510 and the upper tissue roll 2 is reduced or prevented.

Figure 14B:
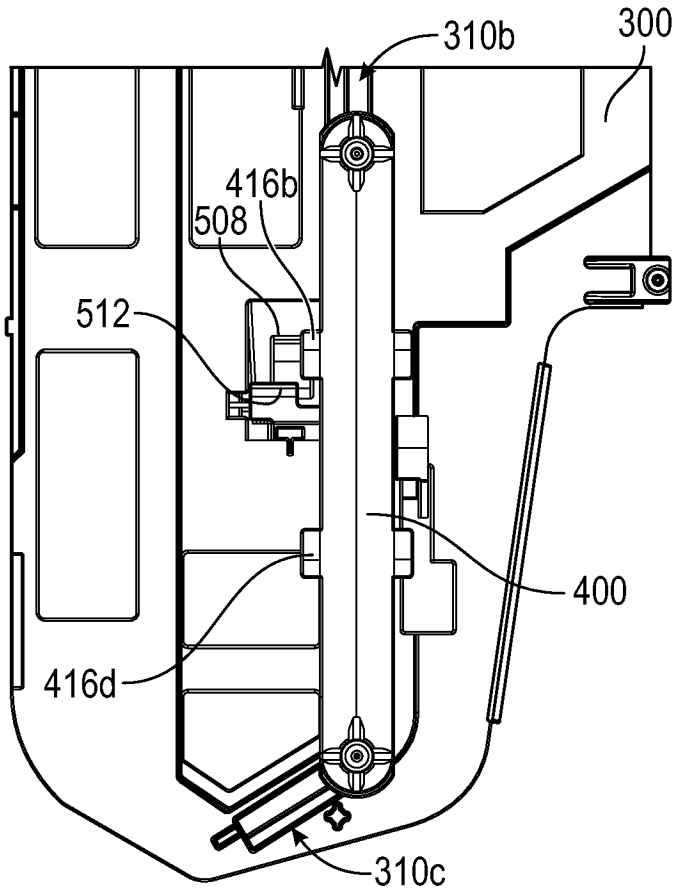
FIGS. 14A-15B illustrate views of a portion of the tissue dispenser in accordance with aspects of this disclosure.
Figure 14A:
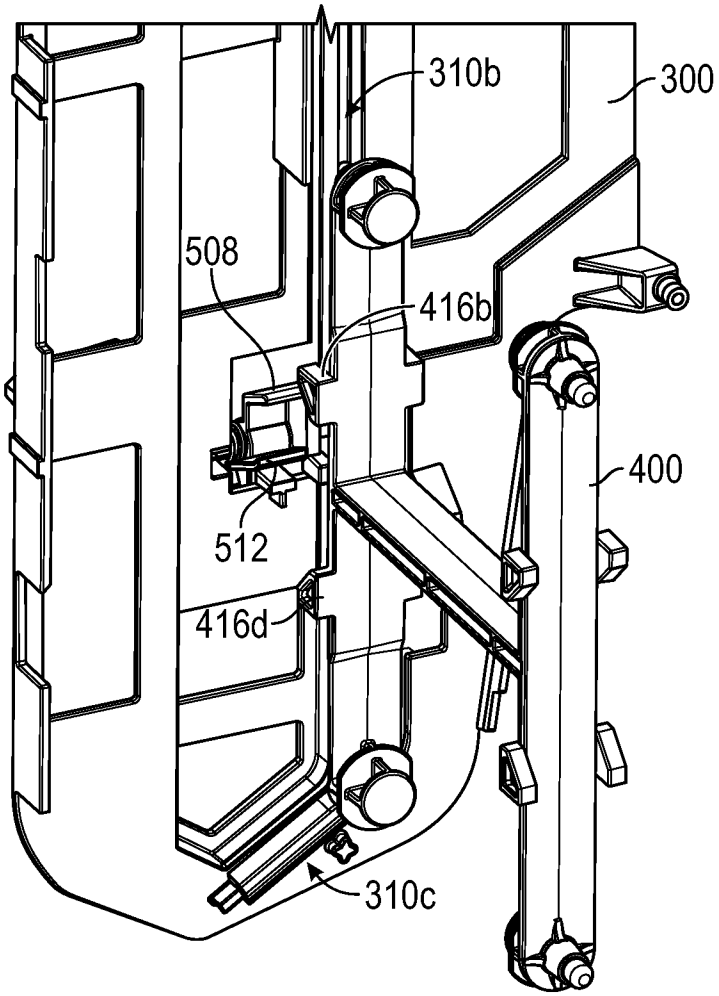

FIGS. 14A-14B illustrate views of a portion of the support frame 300, mandrel 400, and lever assembly 500 with the support frame 200 removed. FIGS. 14A-14B illustrate the mandrel 400 within the straight portion 310*b* of the channel 310. While the support frame 200 is not illustrated in FIGS. 14A-14B, it is to be understood that the mandrel 400 can also be within the straight portion 210*b* of the support frame 200 when in the position shown. As shown, the flange 416*b* of the mandrel 400 can be positioned within a space defined by the distance $d_1$ between an end of the flange 512 and an end of the arm 508.

Figure 15B:
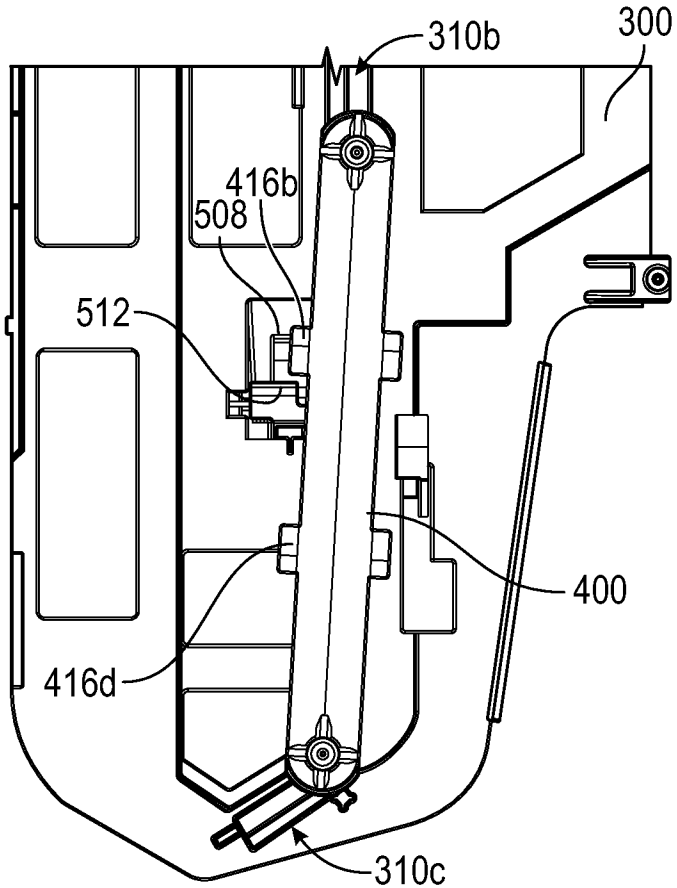
Figure 15A:
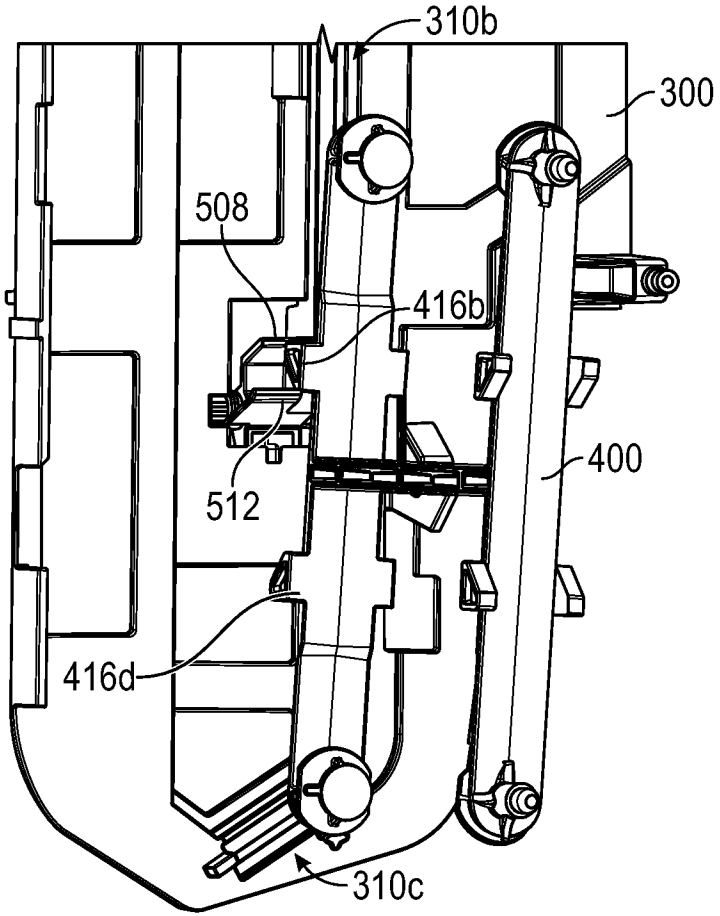

FIGS. 15A-15B illustrate views of the portion of the support frame 300, mandrel 400, and the lever assembly 500 shown in FIGS. 14A-14B with the support frame 200 removed. However, FIGS. 15A-15B illustrate the mandrel 400 when it is moving through the angled portion 310*c* of the channel 310 of the support frame 300. As can be seen in FIGS. 15A-15B, when the mandrel 400 moves through the angled portion 310*c*, the flange 416*b* of the mandrel 400 can be moved and/or rotated such that the flange 416*b* contacts the flange 512 of the lever 502. Such contact can cause the lever 502 to move, which can in turn can cause the arm 510 to move. For example, such contact of the flange 416*b* with the flange 512 can cause the lever 502 to rotate (e.g., about an axis extending through the pin 501) such that the arm 510 is rotated away from a portion of the upper tissue roll 2. For example, with reference to FIG. 12C, such rotation can cause the arm 510 to move and/or rotate in a direction away from the support frame 200 (e.g., move to the "right" given the view shown in FIG. 12C). Accordingly, the flange 512 of the lever 502 can provide a mechanism by which the arm 510 is automatically moved away from the upper tissue roll 2 when the mandrel 400 moves through the angled portion 310*c*. Additionally, in some variants, the offsetting of the flange 512 relative to the arm 508 (discussed above) can allow the flange 512 to engage (e.g., interfere with) the mandrel 400 after the mandrel 400 has moved from the upper position to the lower position, is at or near the lower position, and/or when the mandrel 400 moves through the angled portion 310*c*. While the above discussion was made with reference to the angled portion 310*c* and straight portion 310*b* of the channel 310 of the support frame 300, it is to be understood that the mandrel 400 can move through the angled portion 210*c* and the straight portion 210*b* of the channel 210 of the support frame 200 in a similar manner.

Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Summary

Several illustrative embodiments of tissue roll dispensers and associated methods have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and other implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in other implementations. Also, the separation of various components in the implementations described above should not be understood as requiring such separation in all implementations, and it should be understood that the described components and systems can generally be integrated together in a single product or packaged into multiple products. Additionally, other implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. It is to be understood that not necessarily any or all such advantages are achieved in accordance with any particular embodiment of the inventions disclosed herein. No aspects of this disclosure are essential or indispensable. In many embodiments, the tissue dispensers may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of tissue roll dispensers and methods related to the same have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

The following is claimed:

1. An apparatus for dispensing consumable material, the apparatus comprising:

a housing comprising a cabinet, an interior, and an opening;

a first support frame positioned within the interior of the housing and mounted to the cabinet;

a second support frame positioned within the interior of the housing and mounted to the cabinet, the second support frame being spaced apart from the first support frame;

a mandrel positioned between the first support frame and the second support frame, the mandrel being movable between an upper position and a lower position relative to the first support frame and the second support frame;

the mandrel configured to hold an upper roll of consumable material and a lower roll of consumable material, wherein, when the mandrel is in the upper position, the lower roll is accessible to a user via the opening of the housing, and when the mandrel is in the lower position the upper and lower rolls are accessible to the user via the opening; and a lever operatively connected to the first support frame and moveable between a first position and a second position, the lever configured such that:

when the lever is in the first position, a portion of the lever presents a physical interference that inhibits the mandrel from moving from the upper position to the lower position; and when the lever is moved to the second position, the physical interference is removed, thereby allowing the mandrel to move from the upper position to the lower position.

2. The apparatus of claim 1, wherein the lever comprises a first arm and a second arm, and wherein, when the lever is in the first position, the first arm contacts the lower roll and the second arm presents the physical interference that inhibits the mandrel from moving from the upper position to the lower position.

3. The apparatus of claim 2, wherein:

when a diameter of the lower roll is greater than or equal to a threshold, the lower roll presents a physical obstacle to the first arm of the lever and prevents the lever from moving from the first position to the second position; and when the diameter falls below the threshold, the physical obstacle is removed, thereby allowing the lever to move from the first position to the second position.

4. The apparatus of claim 2, wherein the first arm of the lever is closer to the second support frame when the lever is in the second position than when the lever is in the first position.

5. The apparatus of claim 2, wherein the mandrel comprises a first stem movably mounted to the first support frame, a second stem movably mounted to the second support frame, and a cross-member connected to and positioned between the first and second stems, and wherein the mandrel is configured to hold the upper and lower rolls between the first and second stems.

6. The apparatus of claim 5, wherein the first stem comprises a first flange, and wherein, when the lever is in the first position, the second arm of the lever contacts the first flange of the first stem.

7. The apparatus of claim 5, wherein:

the first support frame comprises a first channel extending along at least a portion of a first height of the first support frame;

the second support frame comprises a second channel extending along at least a portion of a second height of the second support frame;

the first stem is movably mounted within the first channel of the first support frame; and the second stem is movably mounted within the second channel of the second support frame.

8. The apparatus of claim 7, wherein the first stem comprises a first guide configured to fit within the first channel of the first support frame and the second stem comprises a second guide configured to fit within the second channel of the second support frame, and wherein the first and second guides are configured to allow the first and second stems to move within the first and second channels.

9. The apparatus of claim 8, wherein the first stem further comprises a first stub configured to secure to a first portion of the lower tissue roll and the second stem further comprises a second stub configured to secure to a second portion of the lower tissue roll, and wherein the first guide and the first stub extend from the first stem in opposite directions, and wherein the second guide and the second stub extend from the second stem in opposite directions.

10. The apparatus of claim 1, wherein the lever is pivotably connected to the first support frame.

11. The apparatus of claim 1, wherein the lever is biased toward the second position.

12. The apparatus of claim 11, wherein the lever is connected to the first support frame via a pin and a torsional spring coupled to the pin, the torsional spring configured to bias the lever toward the second position.

13. The apparatus of claim 1, further comprising a cover that is movably mounted to the cabinet.

14. An apparatus for dispensing consumable material, the apparatus comprising:

a housing comprising a cabinet, an interior, and an opening;

a first support frame positioned within the interior of the housing and mounted to the cabinet;

a second support frame positioned within the interior of the housing and mounted to the cabinet, the second support frame being spaced apart from the first support frame;

a mandrel movably mounted to the first and second support frames and configured to hold an upper roll of consumable material and a lower roll of consumable material;

the mandrel being movable between an upper position and a lower position, and wherein, when the mandrel is in the upper position, only the lower roll is accessible to a user via the opening of the housing, and wherein, when the mandrel is in the lower position, the upper and lower rolls are accessible to the user via the opening of the housing; and a lever configured to move from a first position in which the lever inhibits movement of the mandrel from the upper position to the lower position to a second position in which said movement is allowed.

15. The apparatus of claim 14, wherein the lever is operatively connected to the first support frame and is configured such that:

when the lever is in the first position, a portion of the lever presents a physical interference that inhibits the mandrel from moving from the upper position to the lower position; and when the lever is moved to the second position, the physical interference is removed, thereby allowing the mandrel to move from the upper position to the lower position.

16. The apparatus of claim 15, wherein the lever comprises a first arm and a second arm, and wherein, when the lever is in the first position, the first arm contacts the lower roll and the second arm presents the physical interference that inhibits the mandrel from moving from the upper position to the lower position.

17. The apparatus of claim 16, wherein the mandrel comprises a first stem movably mounted to the first support frame, a second stem movably mounted to the second support frame, and a cross-member connected to and positioned between the first and second stems, and wherein the mandrel is configured to hold the upper and lower rolls between the first and second stems.

18. The apparatus of claim 17, wherein the first stem comprises a first flange, and wherein, when the lever is in the first position, the second arm of the lever contacts the first flange of the first stem.

19. The apparatus of claim 17, wherein:

the first support frame comprises a first channel extending along at least a portion of a first height of the first support frame;

the second support frame comprises a second channel extending along at least a portion of a second height of the second support frame;

the first stem is movably mounted within the first channel of the first support frame; and the second stem is movably mounted within the second channel of the second support frame.

20. The apparatus of claim 19, wherein the first stem comprises a first pair of guides and the second stem comprises a second pair of guides, and wherein the first pair of guides are configured to move within the first channel of the first support frame and the second pair of guides are configured to move within the second channel of the second support frame.

21. The apparatus of claim 14, wherein the lever is configured to disengage from the mandrel in response to the lever detecting that an outside diameter of the lower roll is less than a threshold value, thereby allowing the mandrel to automatically drop from the upper position to the lower position.

* * * * *